US009789702B2

(12) United States Patent
Kawai

(10) Patent No.: US 9,789,702 B2
(45) Date of Patent: Oct. 17, 2017

(54) PRINTER

(71) Applicant: Brother Kogyo Kabushiki Kaisha, Nagoya-shi, Aichi-ken (JP)

(72) Inventor: Junya Kawai, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/633,728

(22) Filed: Feb. 27, 2015

(65) Prior Publication Data

US 2015/0246567 A1 Sep. 3, 2015

(30) Foreign Application Priority Data

Feb. 28, 2014 (JP) ..... 2014-039853

(51) Int. Cl.

| | |
|---|---|
| ***B41J 2/375*** | (2006.01) |
| ***B41J 3/407*** | (2006.01) |
| ***B41J 2/32*** | (2006.01) |
| ***B41J 11/42*** | (2006.01) |
| ***B41J 2/325*** | (2006.01) |

(52) U.S. Cl.

CPC ..... *B41J 3/4075* (2013.01); *B41J 2/32* (2013.01); *B41J 2/325* (2013.01); *B41J 2/375* (2013.01); *B41J 11/42* (2013.01)

(58) Field of Classification Search

CPC ..... B41J 2/375; B41J 3/4075; B41J 2/32
See application file for complete search history.

(56) References Cited

U.S. PATENT DOCUMENTS 6,132,119 A 10/2000 Nakajima et al.
2007/0086056 A1 4/2007 Hsieh
2011/0018918 A1* 1/2011 Kanda ..... B41J 3/4075 347/9

FOREIGN PATENT DOCUMENTS

| | | | |
|---|---|---|---|
| JP | H0538854 | A | 2/1993 |
| JP | H5-185673 | A | 7/1993 |
| JP | H6-155833 | A | 6/1994 |
| JP | H6-198988 | A | 7/1994 |

(Continued)

OTHER PUBLICATIONS

Aug. 22, 2017—(JP) Notification of Reasons for Refusal—App 2014-039853.

*Primary Examiner* — Kristal Feggins
*Assistant Examiner* — Kendrick Liu
(74) *Attorney, Agent, or Firm* — Banner & Witcoff, Ltd.

(57) ABSTRACT

The disclosure discloses a printer comprising a first control portion configured to control a feeder and a conducting device to perform printing on a recording medium. The first control portion executing a first processing, a second processing, and a third processing. In the first processing, printing on the recording medium is performed while feeding the recording medium to a forward direction, based on first print data. In the second processing, printing on a first predetermined section is performed while continuously feeding the recording medium to the forward direction, based on second print data, triggered by receipt of a print stop instruction in the middle of the first processing. In the third processing, feeding the recording medium to a reverse direction is performed and, with current conduction to the heating elements stopped, making the heating elements face the first predetermined section for a first predetermined amount of time.

13 Claims, 23 Drawing Sheets

(56) References Cited

FOREIGN PATENT DOCUMENTS

| | | | |
|---|---|---|---|
| JP | 2002-254757 | A | 9/2002 |
| JP | 2011-042160 | A | 3/2011 |
| JP | 2011-230428 | A | 11/2011 |
| JP | 2013-202950 | A | 10/2013 |
| JP | 2013-233663 | A | 11/2013 |

* cited by examiner

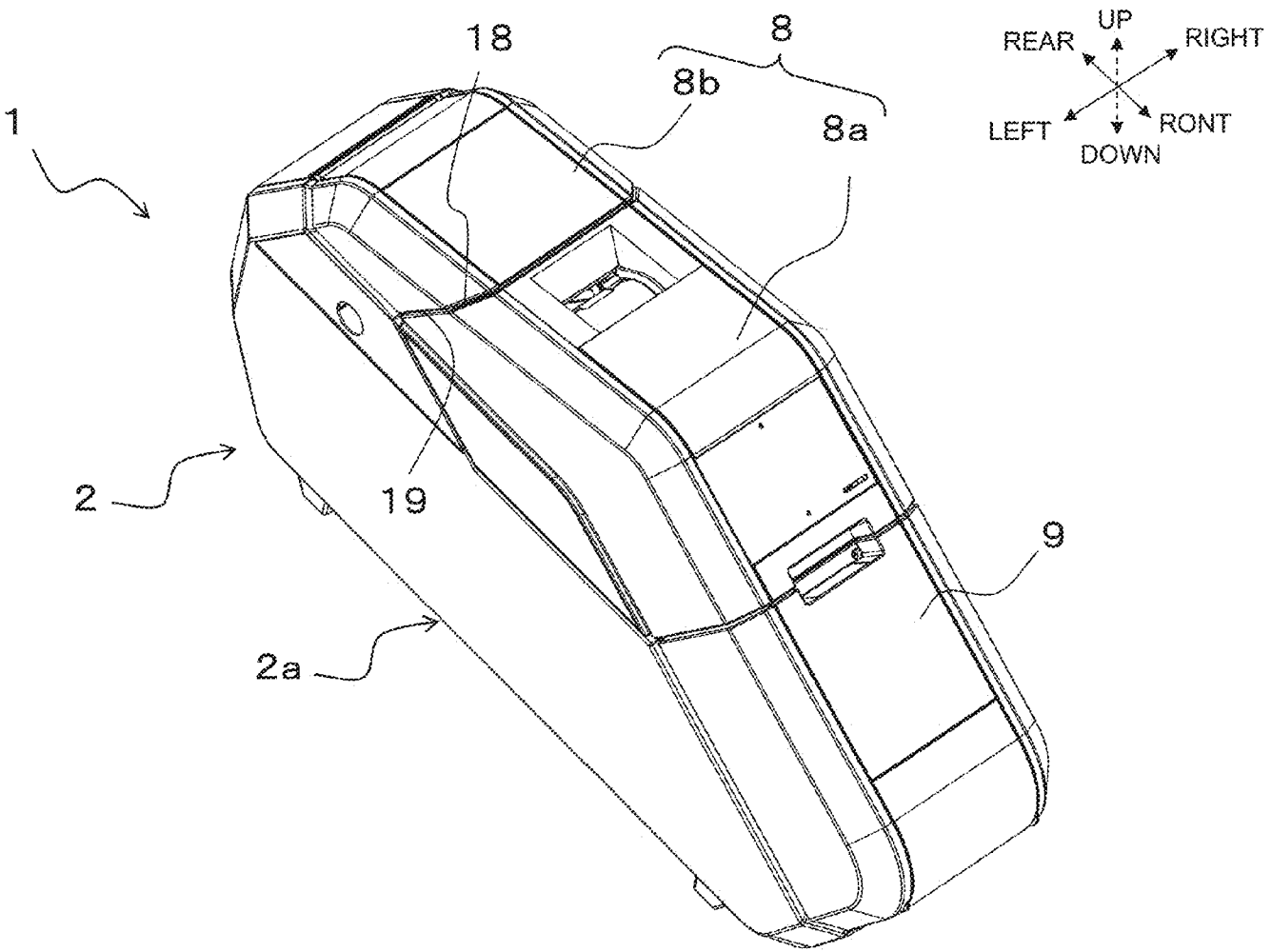
[FIG. 1]

[FIG. 2]
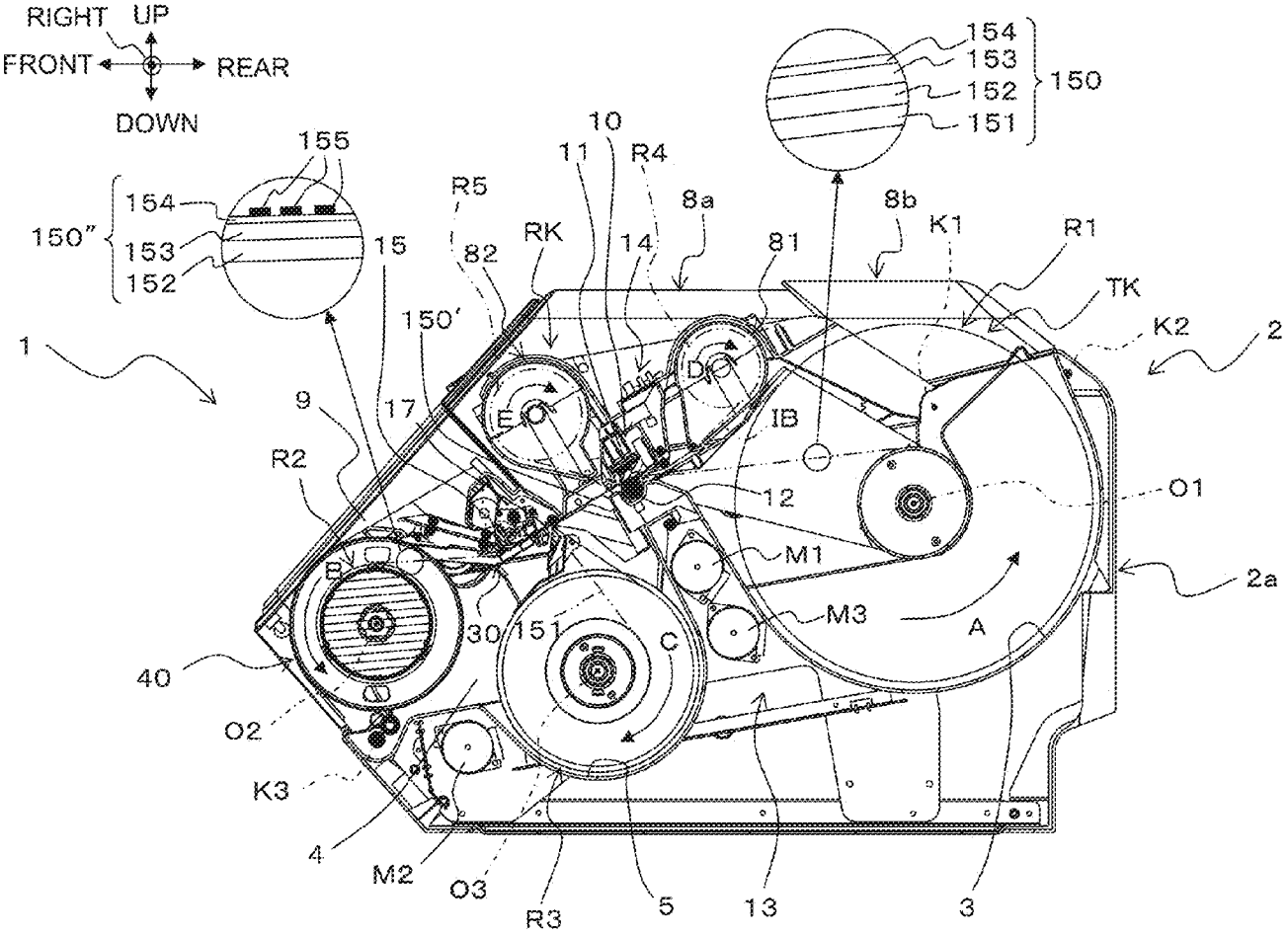

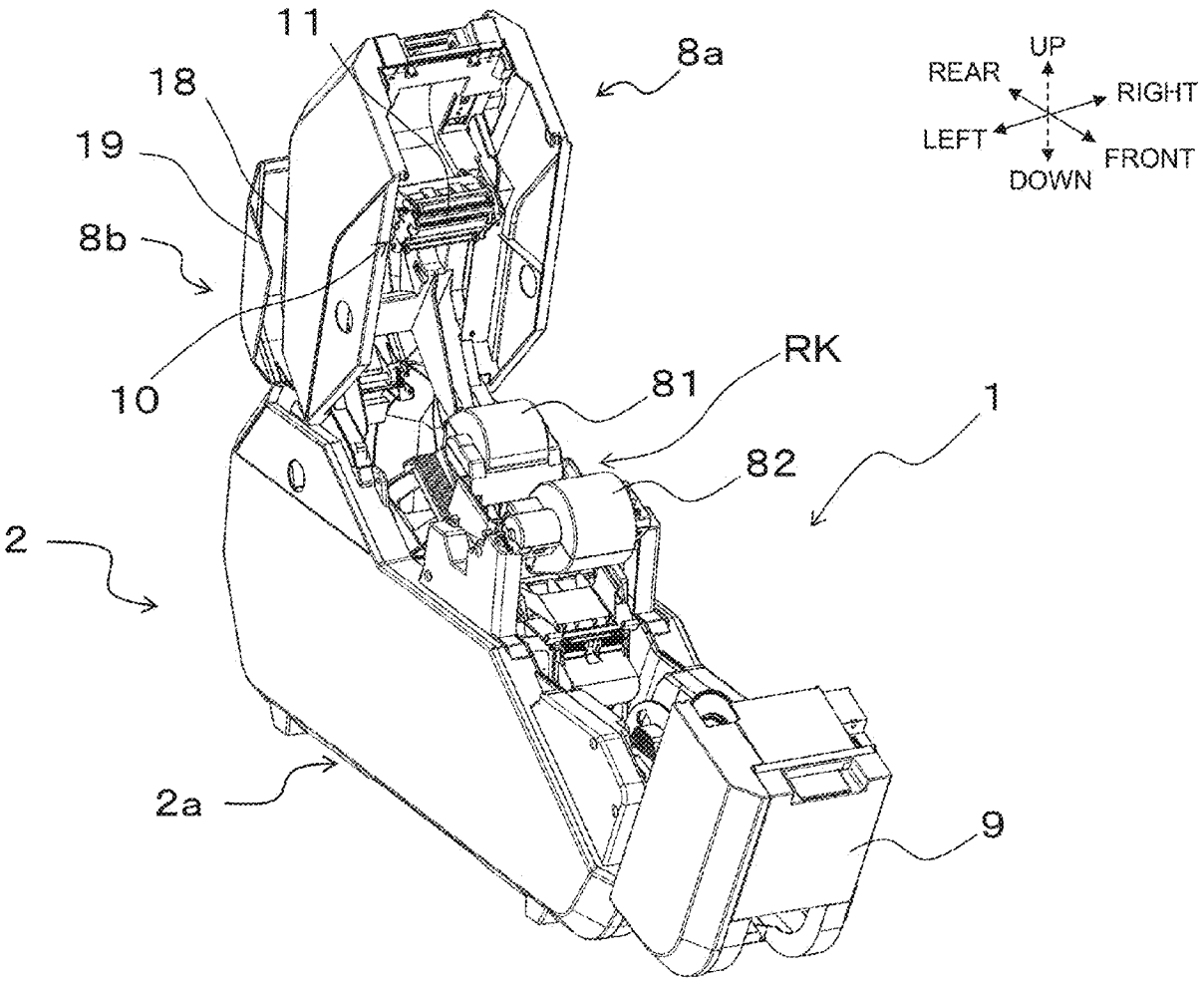
[FIG. 3]

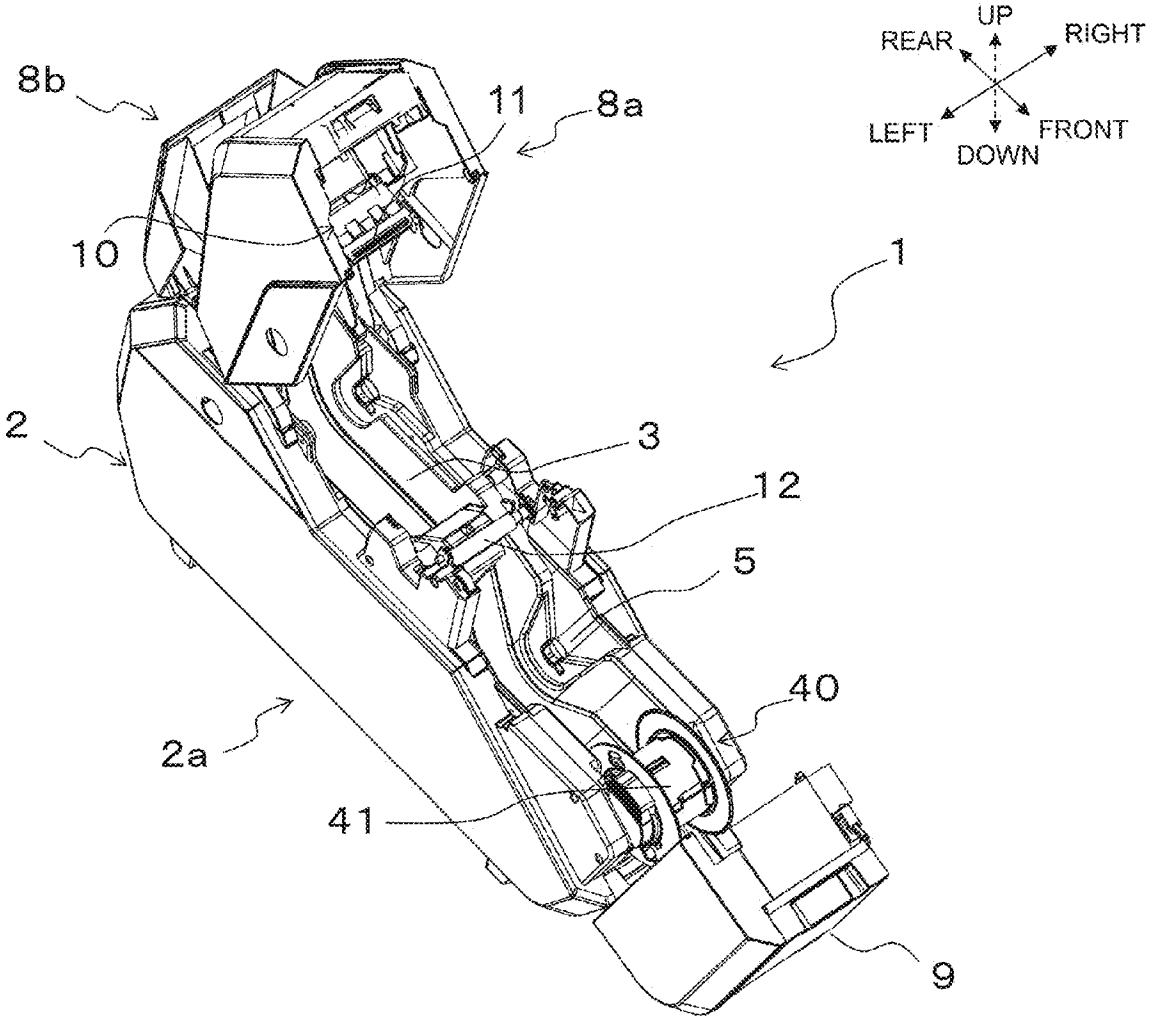
[FIG. 4]

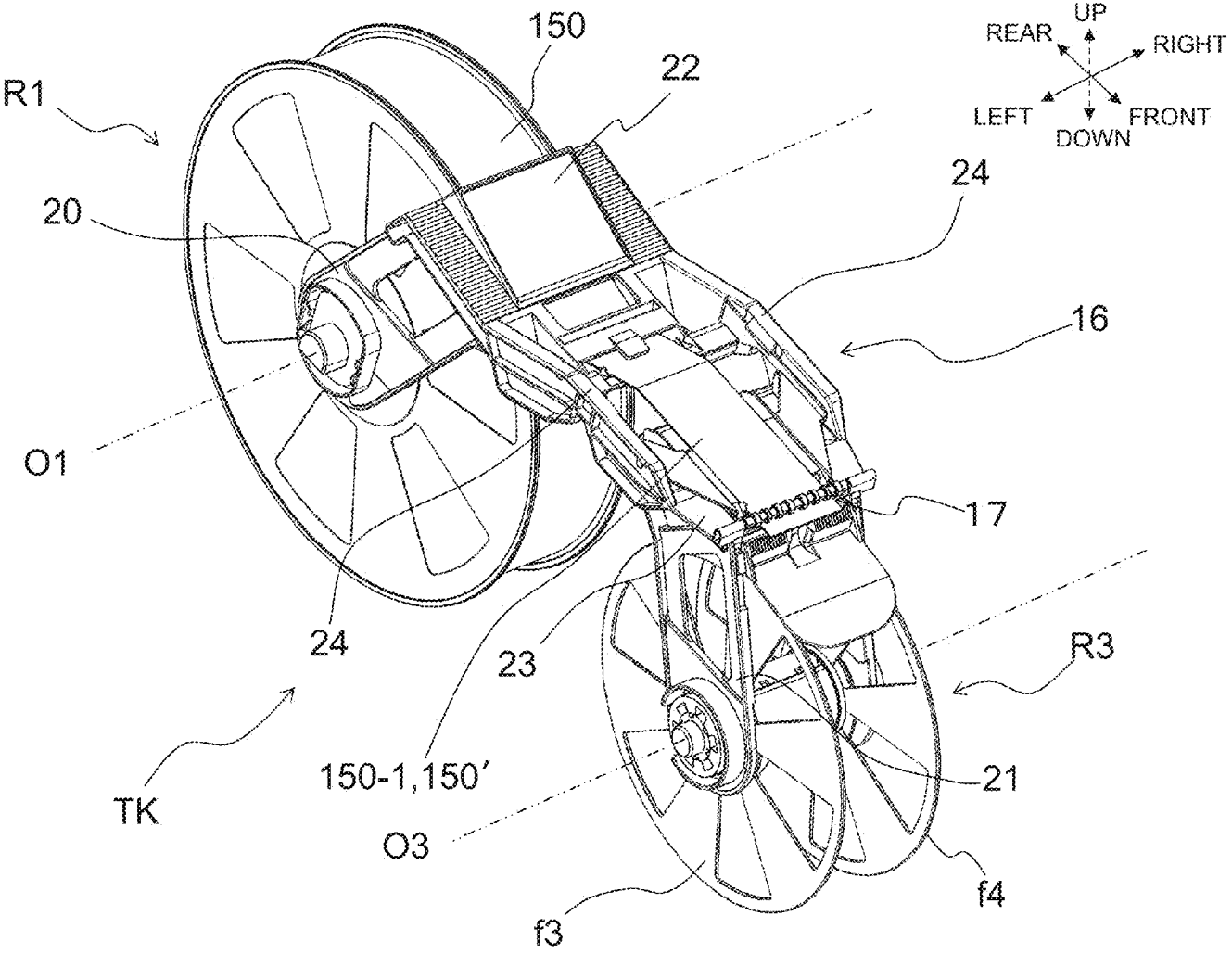
[FIG. 5]

[FIG. 6]
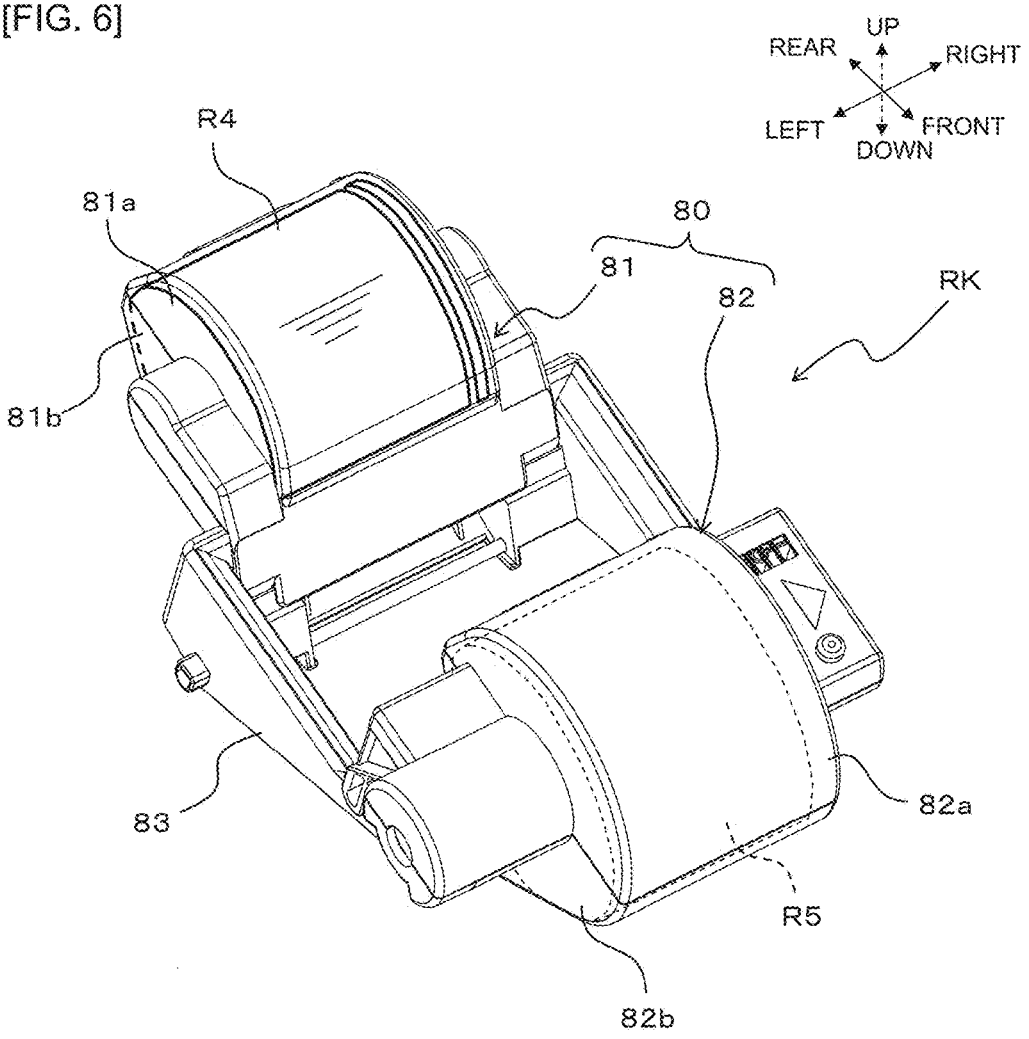

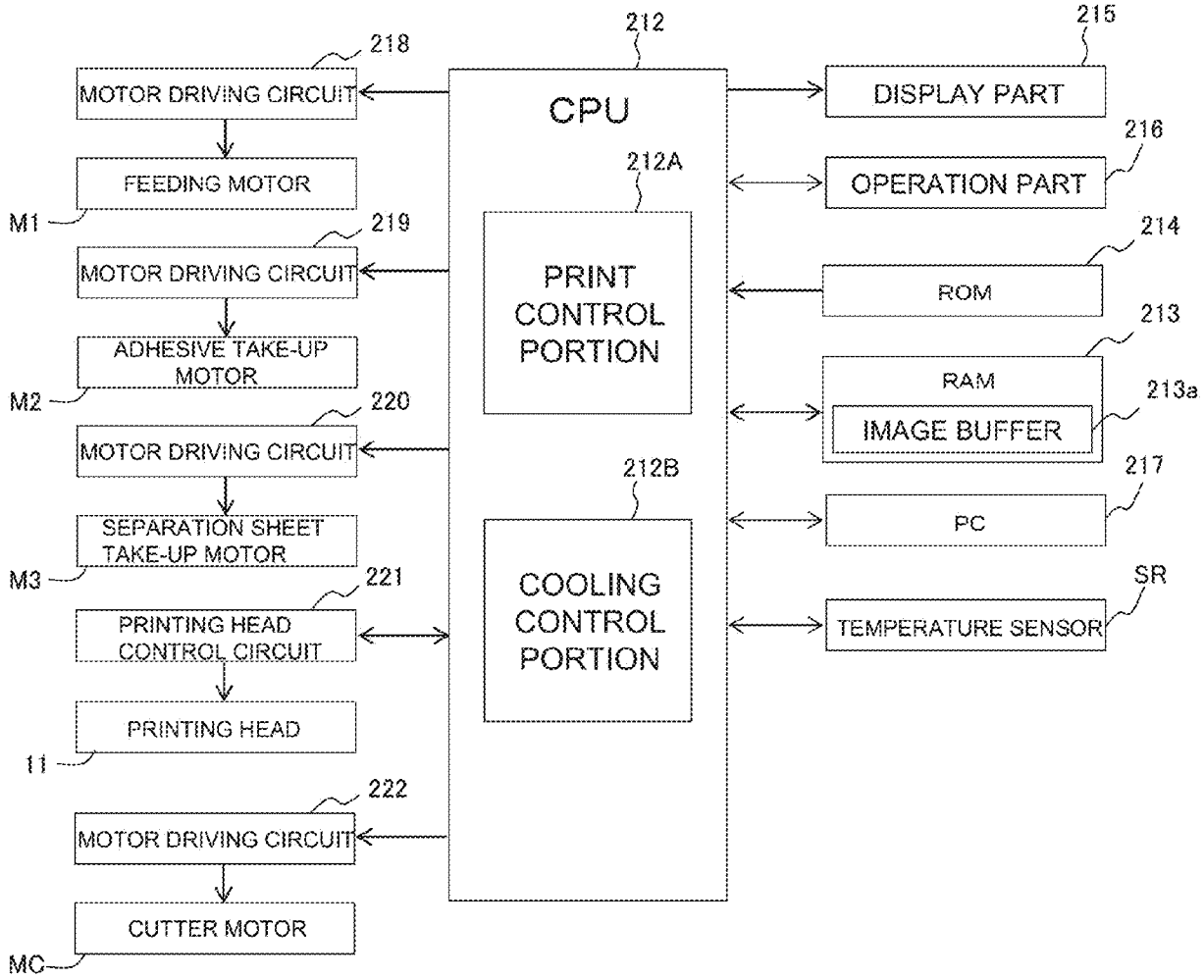
[FIG. 7]

[FIG. 8]
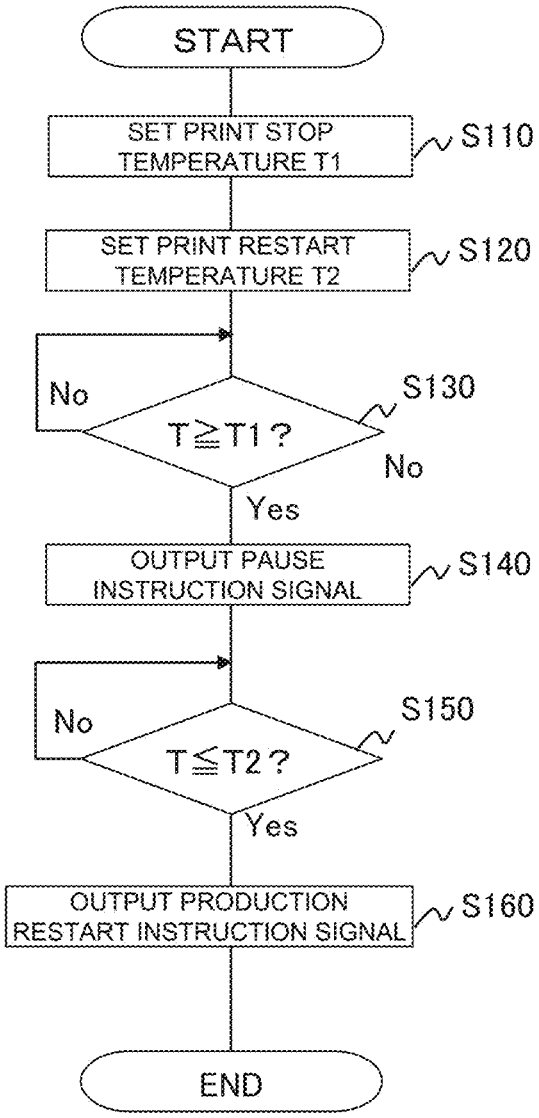

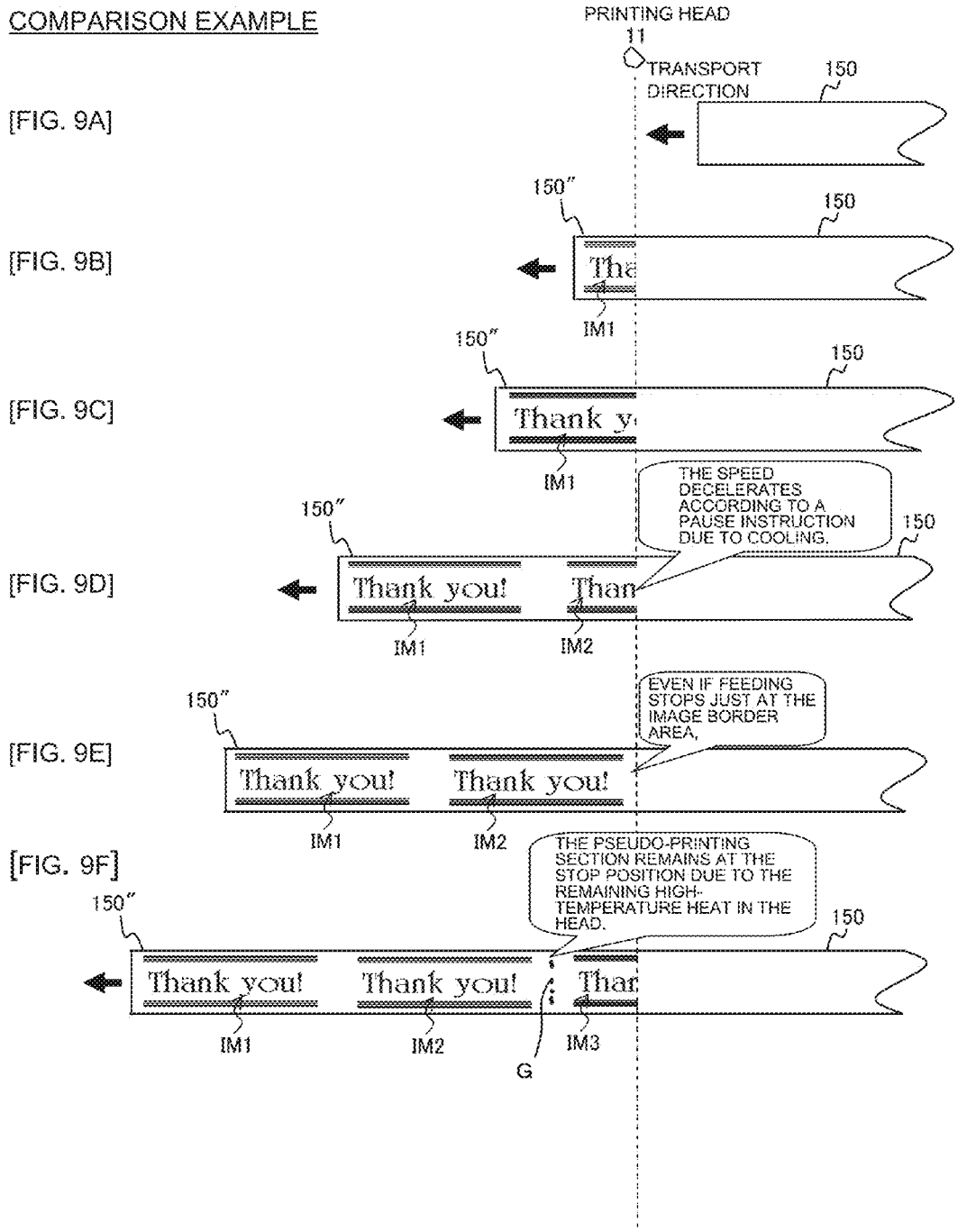
COMPARISON EXAMPLE
PRINTING HEAD
11
TRANSPORT DIRECTION
150
[FIG. 9A]
150″
150
[FIG. 9B]
Tha
IM1
150″
150
[FIG. 9C]
Thank y
IM1
THE SPEED DECELERATES ACCORDING TO A PAUSE INSTRUCTION DUE TO COOLING.
150″
150
[FIG. 9D]
Thank you!
Than
IM1
IM2
EVEN IF FEEDING STOPS JUST AT THE IMAGE BORDER AREA.
150″
[FIG. 9E]
Thank you!
Thank you!
IM1
IM2
[FIG. 9F]
THE PSEUDO-PRINTING SECTION REMAINS AT THE STOP POSITION DUE TO THE REMAINING HIGH-TEMPERATURE HEAT IN THE HEAD.
150″
150
Thank you!
Thank you!
Than
IM1
IM2
IM3
G EMBODIMENT 1
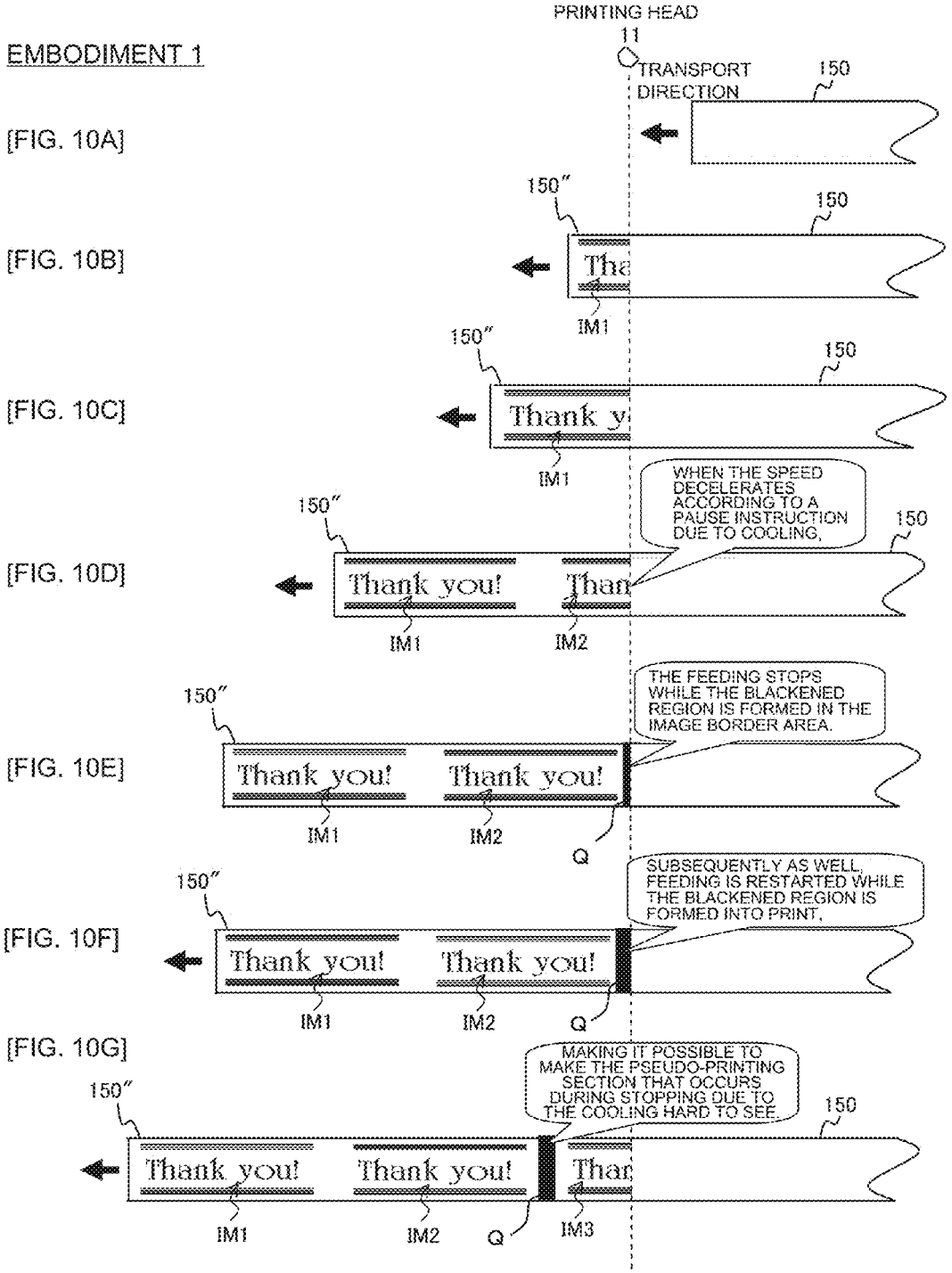

[FIG. 11]
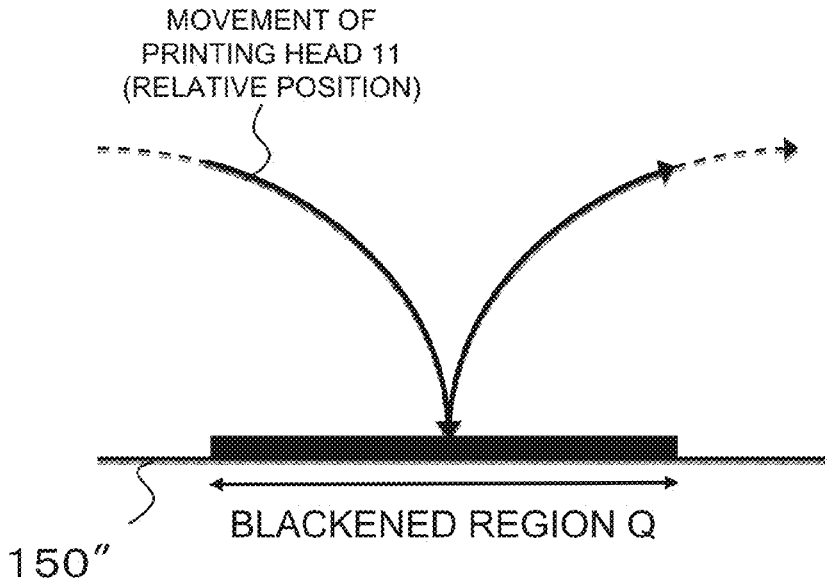

[FIG. 12]
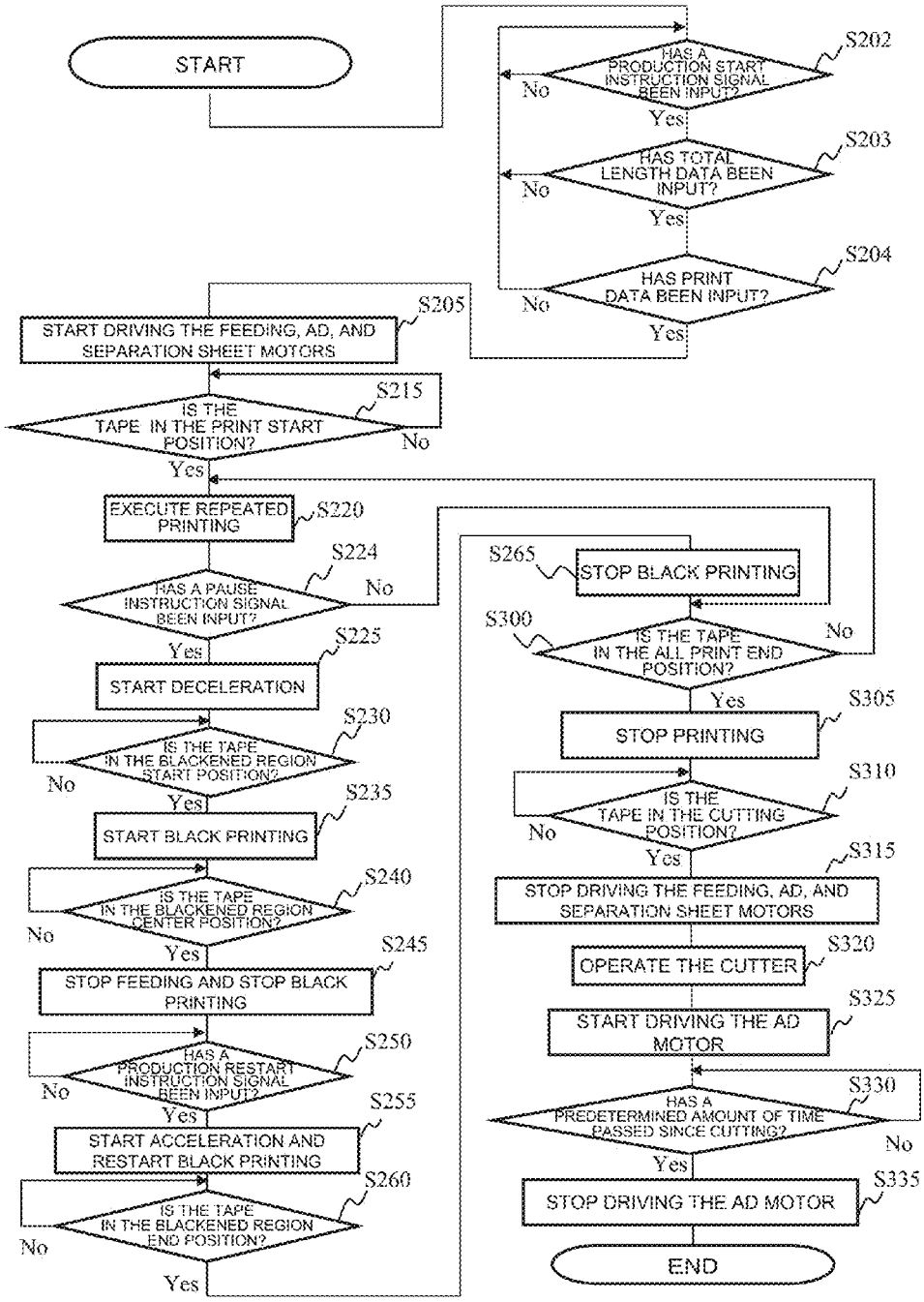

EMBODIMENT 2
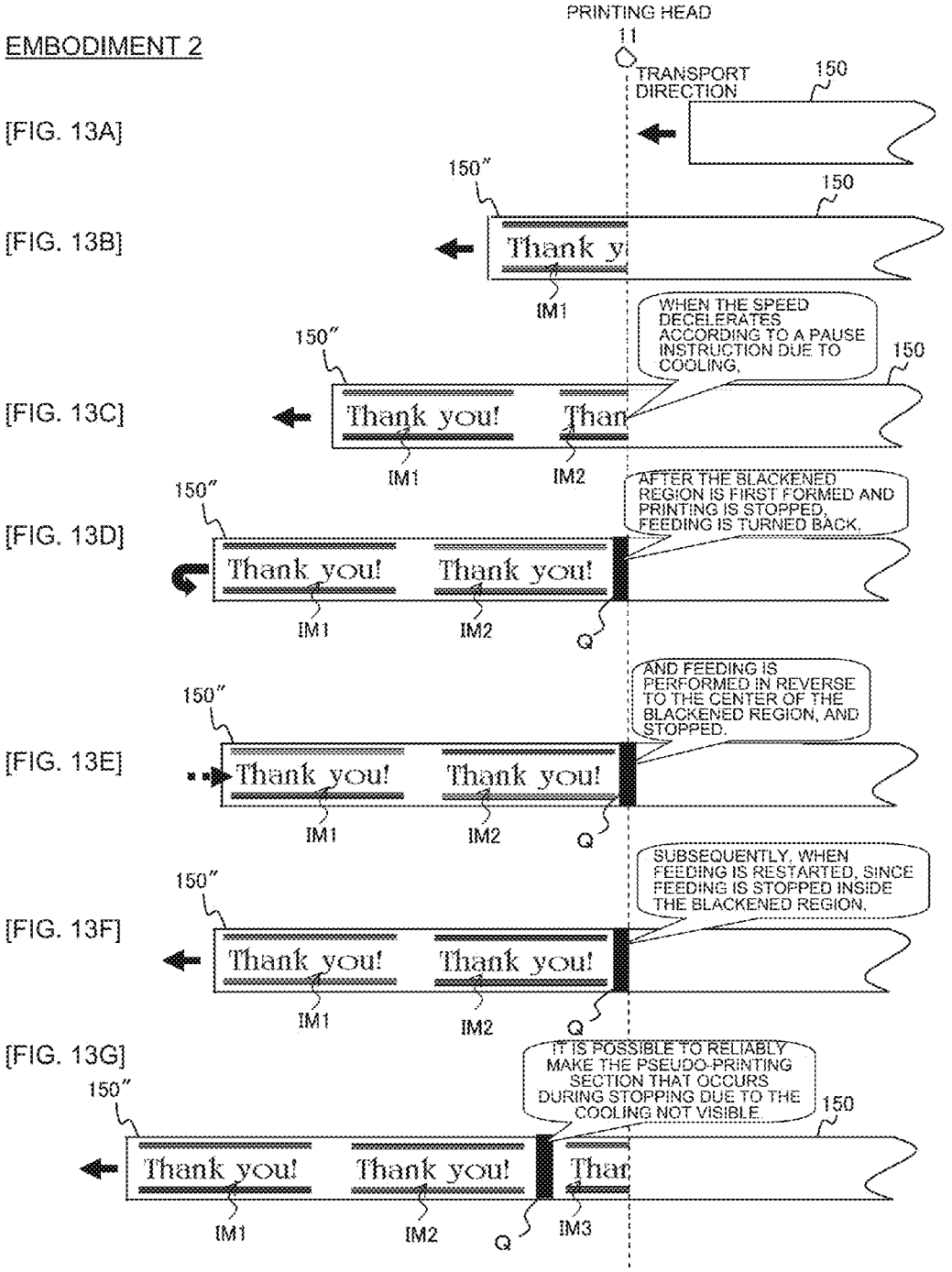

[FIG. 14]
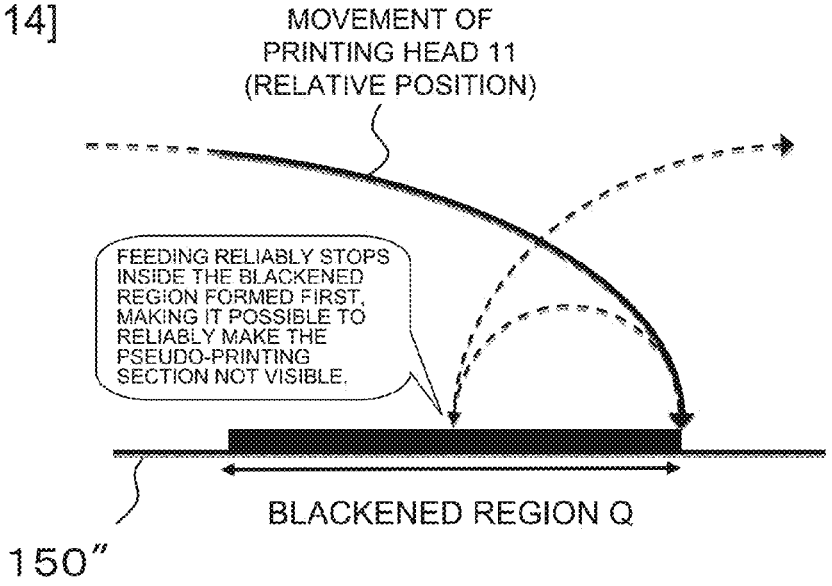

[FIG. 15]
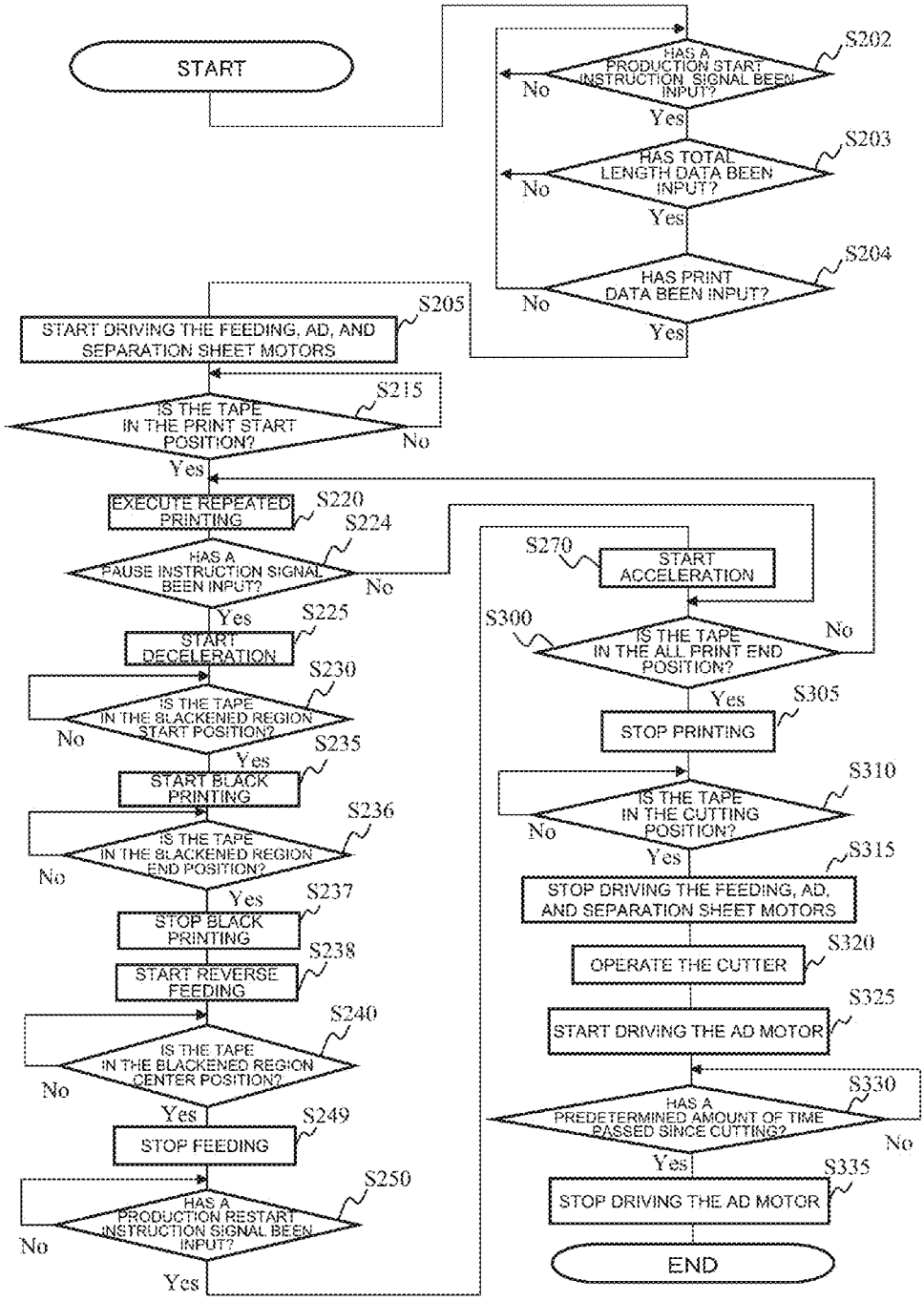

MODIFICATION 1
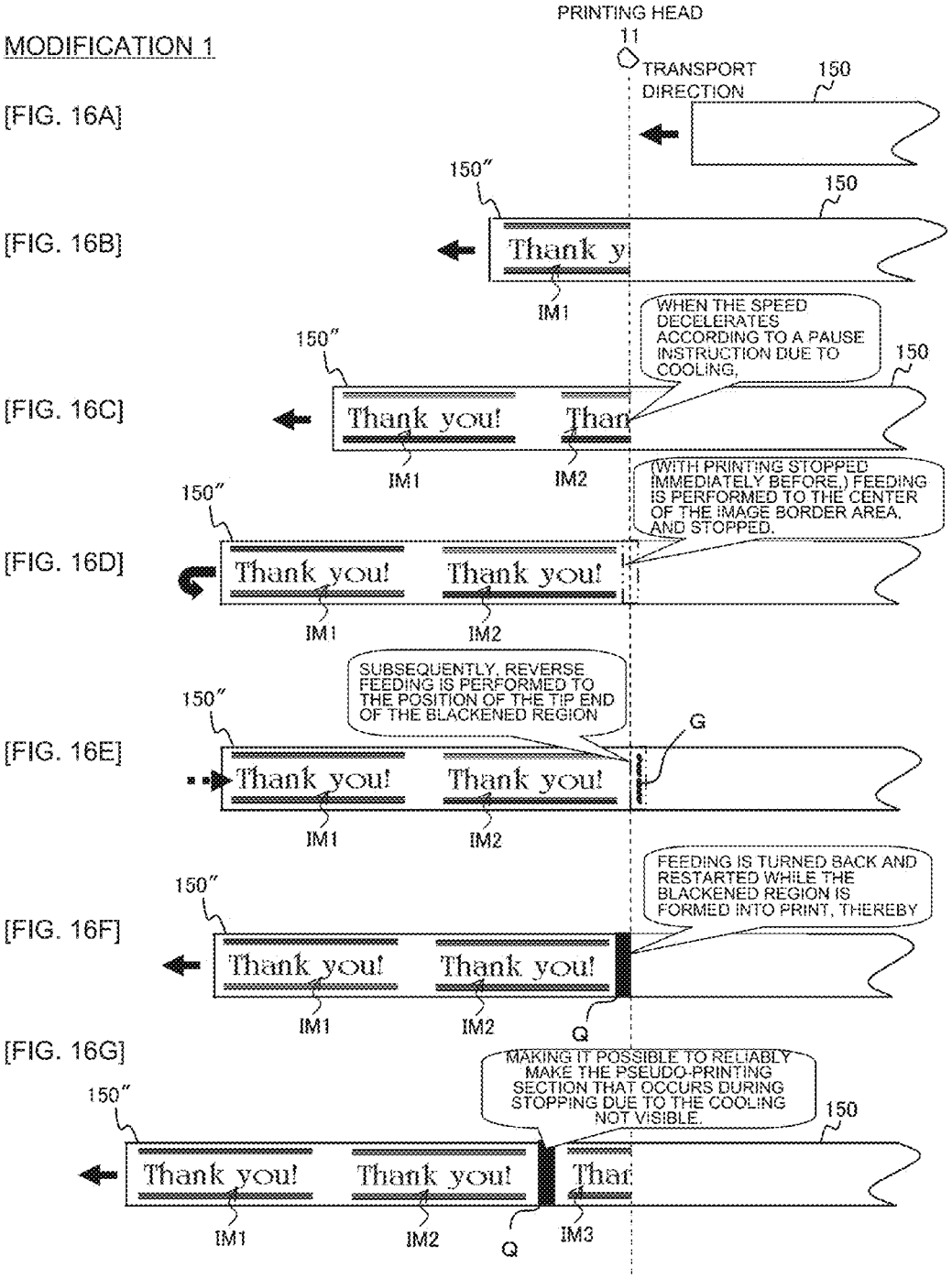

[FIG. 17]
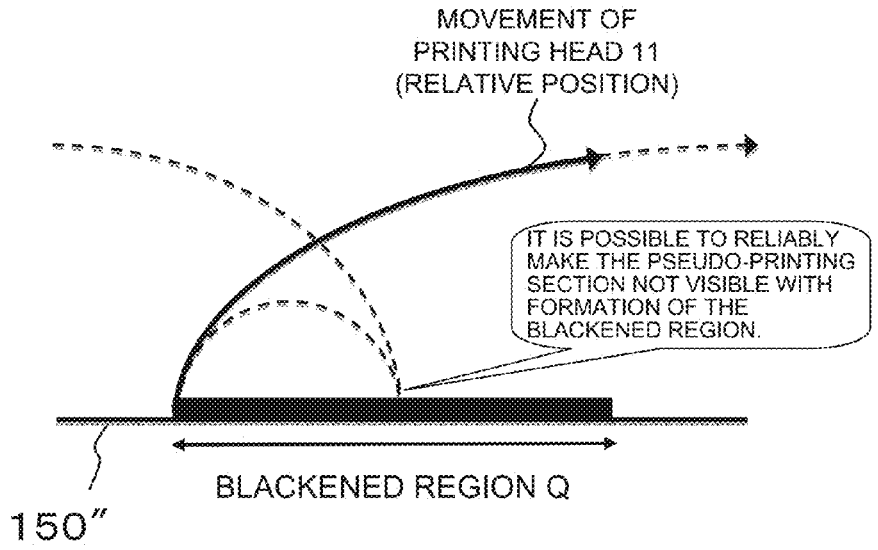

[FIG. 18]
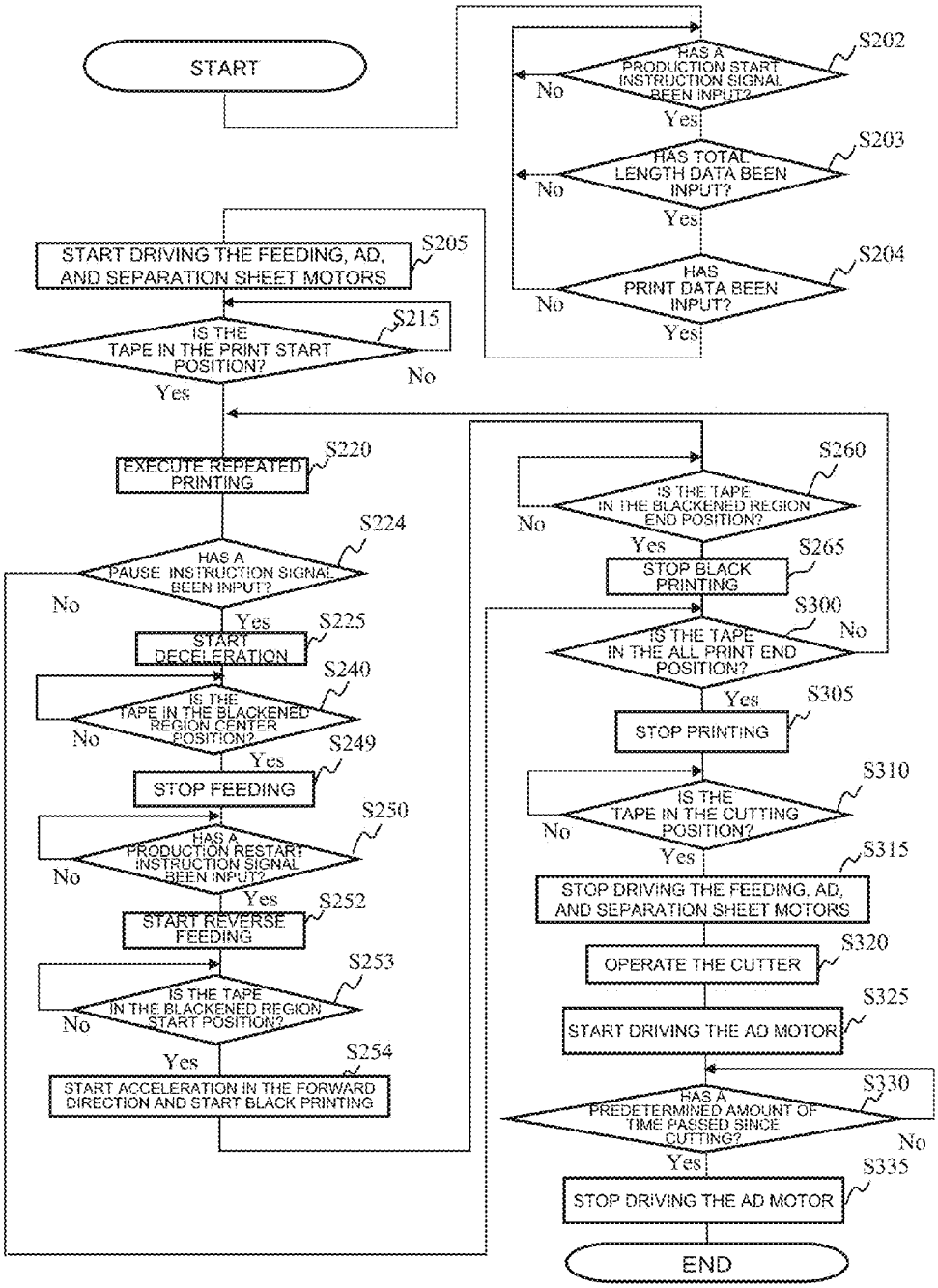

MODIFICATION 2
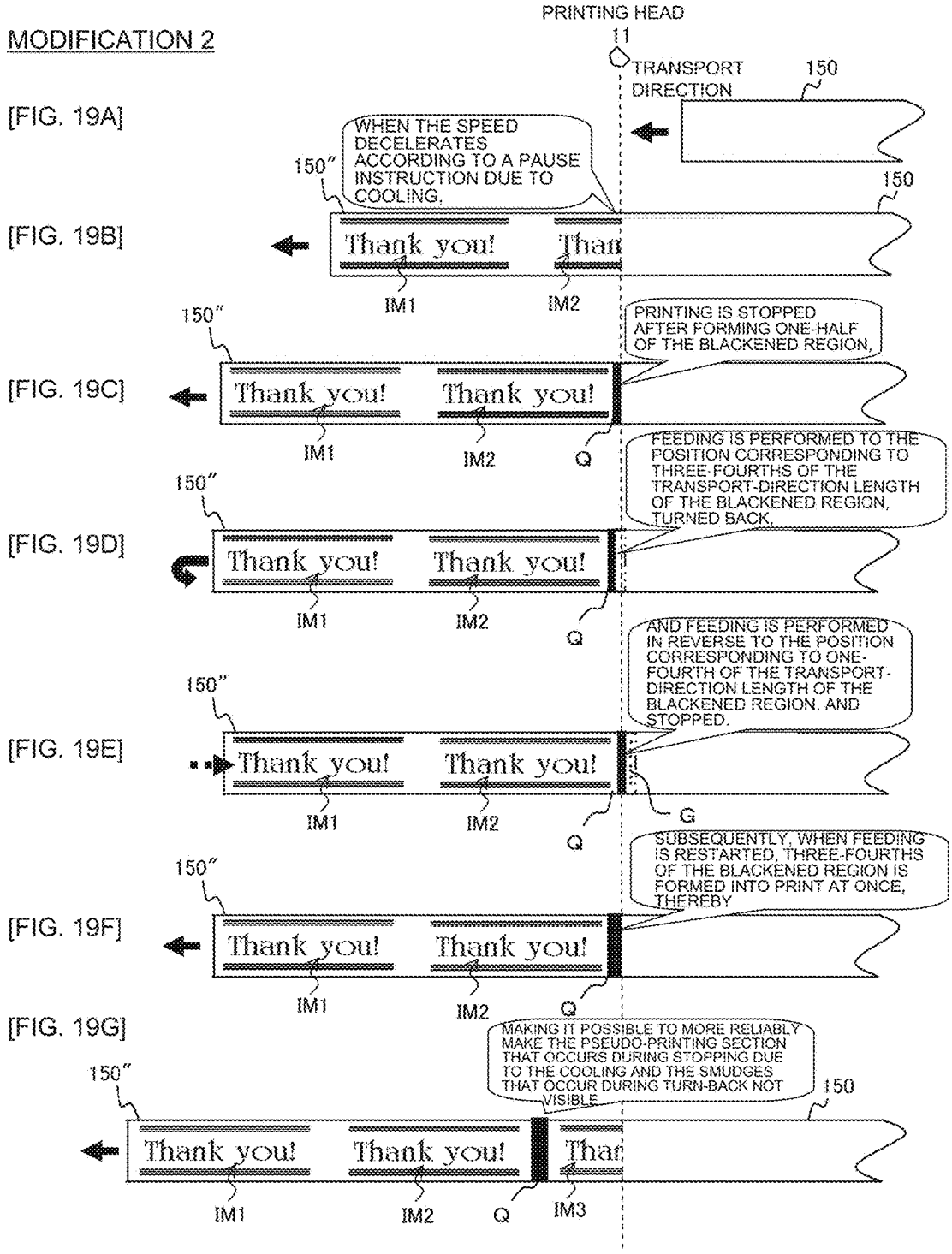

[FIG. 20]
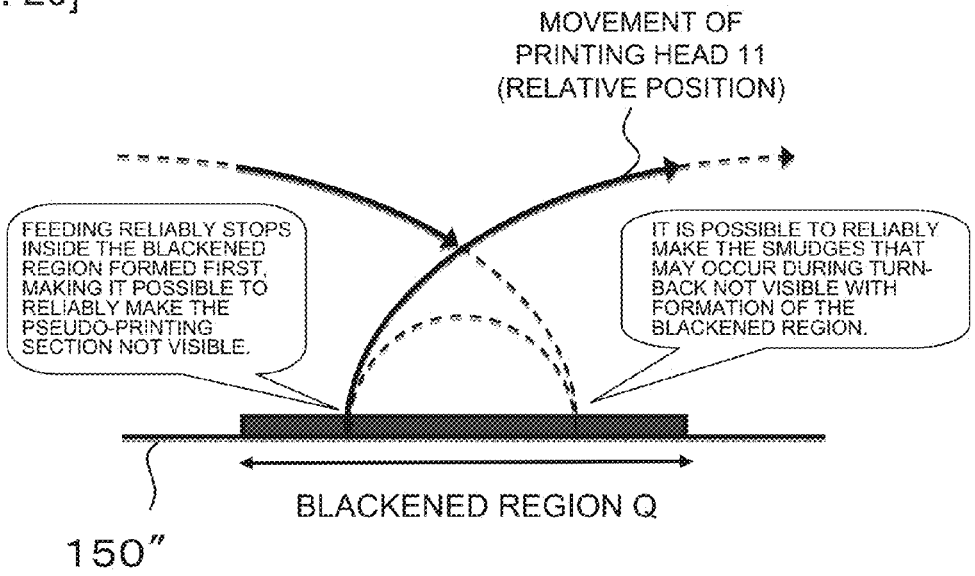

[FIG. 21]
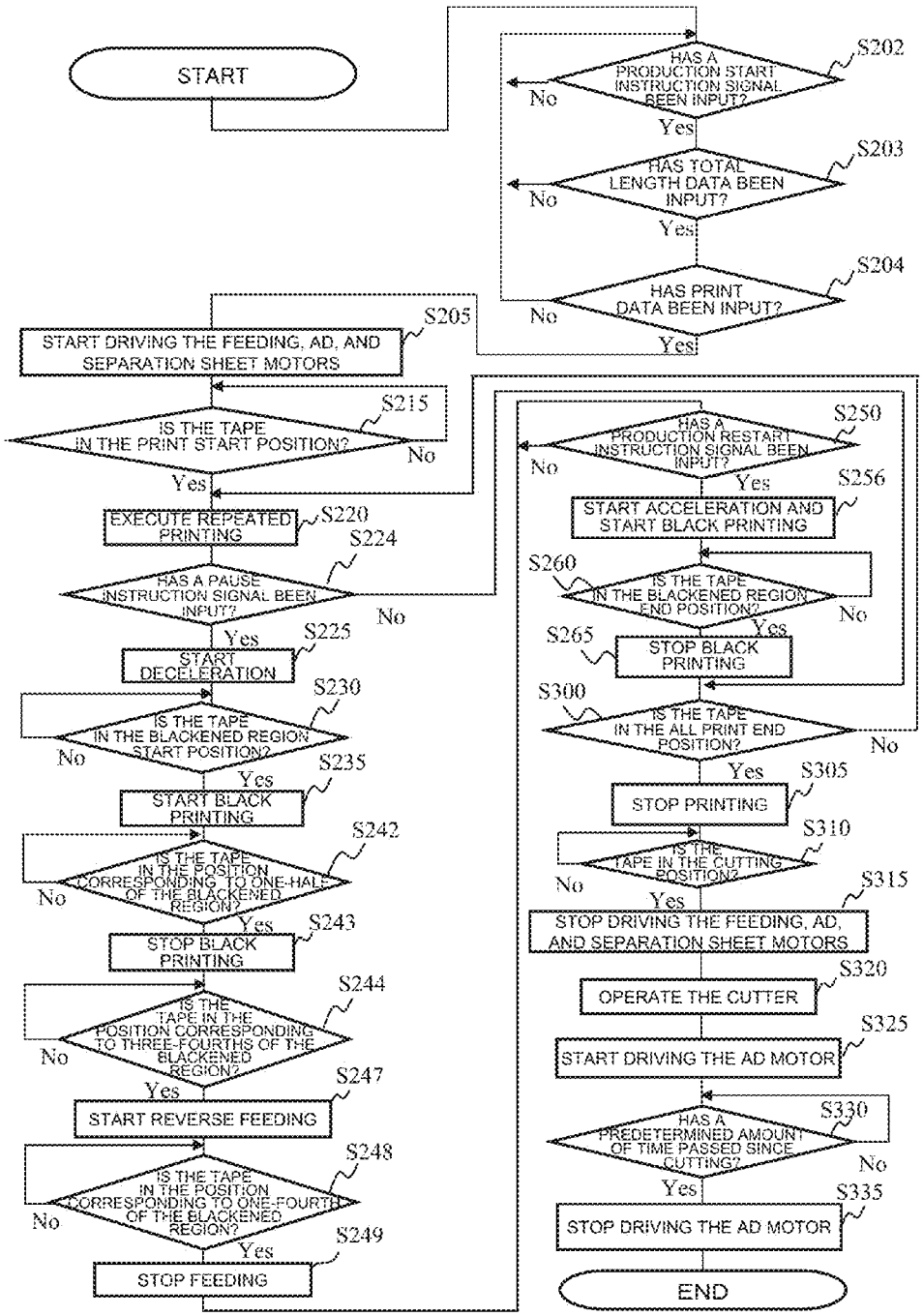

MODIFICATION 3
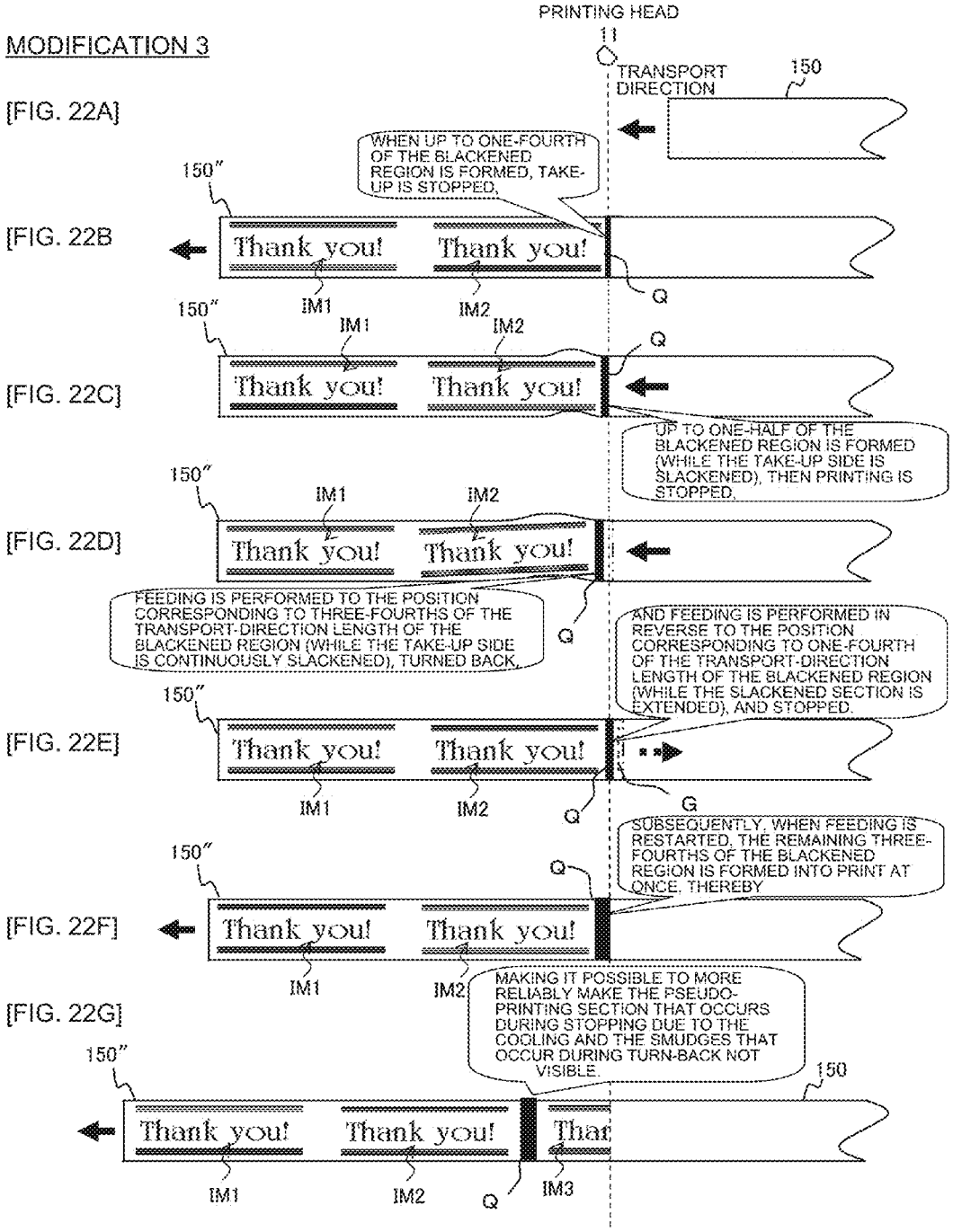

[FIG. 23]
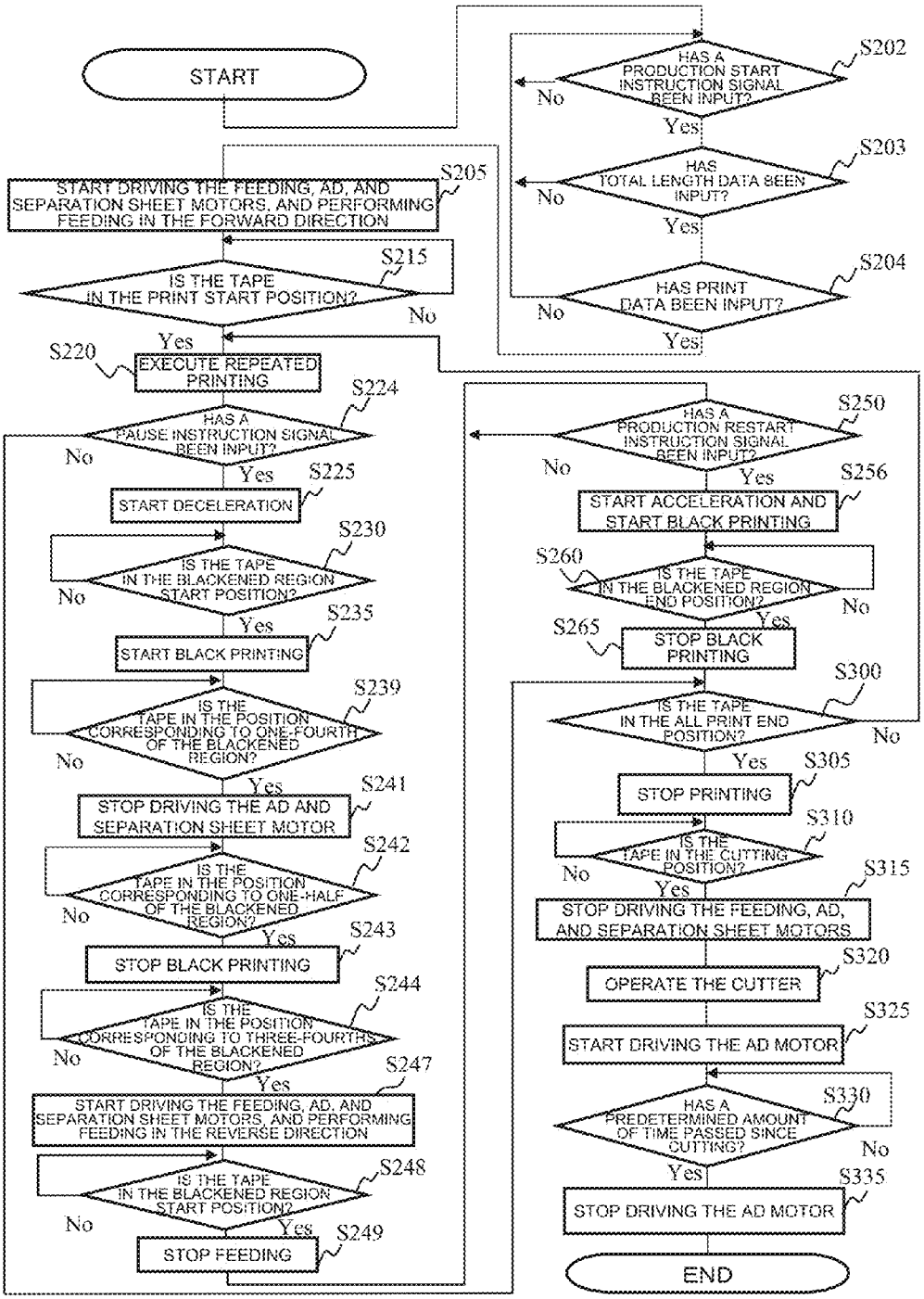

PRINTER

CROSS-REFERENCE TO RELATED APPLICATION

The present application claims priority from Japanese Patent Application No. 2014-039853, which was filed on Feb. 28, 2014, the disclosure of which is incorporated herein by reference in its entirety.

BACKGROUND

Field

The present disclosure relates to a printer that performs desired printing on a recording medium.

Description of the Related Art

There are already known techniques in which, during printing by a printer, so-called cooling is executed as a result of a temperature rise in a thermal head, for example, thereby stopping current conduction to heating elements and suspending printing.

In the prior art described above, while current conduction is stopped as a result of the execution of cooling, a pseudo-printing section is formed on the recording medium by the remaining heat in the thermal head that is high in temperature (even though current conduction is stopped), resulting in the possibility of smudges and thus a loss in aesthetics.

SUMMARY

It is therefore an object of the present disclosure to provide a printer capable of reducing the appearance of smudges formed while current conduction is stopped, thereby improving aesthetics.

In order to achieve the above-described object, according to the first aspect of the present application, there is provided a printer comprising a feeder configured to feed a recording medium along a predetermined feeding path, a thermal head comprising heating elements that face the predetermined feeding path, a conducting device configured to conduct current to the heating elements, and a first control portion configured to control the feeder and the conducting device to perform printing on the recording medium, the first control portion executing a first processing for performing printing on the recording medium while feeding the recording medium to a forward direction along the predetermined feeding path, based on first print data, a second processing for performing printing on a first predetermined section of the recording medium while continuously feeding the recording medium to the forward direction along the predetermined feeding path, based on second print data that differs from the first print data, triggered by receipt of a print stop instruction from an external source in the middle of the first processing, and a third processing for feeding the recording medium to a reverse direction opposite the forward direction along the feeding path and, with current conduction to the heating elements stopped, making the heating elements face the first predetermined section of the recording medium for a first predetermined amount of time, after the second processing.

In order to achieve the above-described object, according to the second aspect of the present application, there is provided a printer comprising a feeder configured to feed a recording medium along a predetermined feeding path, a thermal head comprising heating elements that face the predetermined feeding path, a conducting device configured to conduct current to the heating elements, and a second control portion configured to control the feeder and the conducting device to perform printing on the recording medium, the second control portion executing a fifth processing for performing printing on the recording medium while feeding the recording medium to a forward direction along the predetermined feeding path, based on third print data, a sixth processing for making the heating elements face a second predetermined section of the recording medium for a second predetermined amount of time with current conduction to the heating elements stopped, triggered by receipt of a print stop instruction from an external source in the middle of the fifth processing, a seventh processing for feeding the recording medium to a reverse direction opposite the forward direction along the feeding path, after the sixth processing, and an eighth processing for performing printing on the second predetermined section of the recording medium based on fourth print data that differs from the third print data, while feeding the recording medium to the forward direction along the feeding path, after the seventh processing.

During printing, current conduction is stopped if a print stop instruction is received for some reason or other (such as, for example, execution of so-called cooling as a result of a temperature rise in the thermal head or an emergency stop operation by the operator). In such a case, while current conduction is stopped, a pseudo-printing section is formed on the recording medium by the remaining heat in the thermal head that is high in temperature (even though current conduction is stopped), resulting in the possibility of smudges and thus a loss in aesthetics. Hence, in the present disclosure, when a print stop instruction is received, printing is performed on a first predetermined section and the heating elements to which current conduction has stopped are then made to face the first predetermined section for a first predetermined amount of time (or the heating elements to which current conduction has stopped are made to face a second predetermined section for a second predetermined amount of time, and then printing is performed on the second predetermined section), thereby reducing the appearance of smudges. With this arrangement, it is possible to improve aesthetics.

In order to achieve the above-described object, according to the third aspect of the present application, there is provided a printer comprising a feeder configured to feed a recording medium along a predetermined feeding path, a thermal head comprising heating elements that face the predetermined feeding path, a conducting device configured to conduct current to the heating elements, and a third control portion configured to control the feeder and the conducting device to perform printing on the recording medium, the third control portion executing a ninth processing for performing printing on the recording medium while feeding the recording medium to a forward direction along the predetermined feeding path, based on fifth print data, a tenth processing for performing printing on a third predetermined section of the recording medium while continuously feeding the recording medium to the forward direction along the predetermined feeding path, based on sixth print data that differs from the fifth print data, triggered by receipt of a print stop instruction from an external source in the middle of the ninth processing, an eleventh processing for making the heating elements face a fourth predetermined section adjacent to the third predetermined section of the recording medium for a third predetermined amount of time, with current conduction to the heating elements stopped, after the tenth processing, a twelfth processing for performing printing on a fifth predetermined section adjacent to the fourth predetermined section of the recording medium while feeding the recording medium to the forward direction along the feeding path, based on seventh print data that differs from the fifth print data, after the eleventh processing, and a thirteenth processing for performing printing on the recording medium while feeding the recording medium to the forward direction along the predetermined feeding path, based on the fifth print data, after the twelfth processing.

During printing, current conduction is stopped if a print stop instruction is received for some reason or other (such as, for example, execution of so-called cooling as a result of a temperature rise in the thermal head or an emergency stop operation by the operator). In such a case, while current conduction is stopped, a pseudo-printing section is formed on the recording medium by the remaining heat in the thermal head that is high in temperature (even though current conduction is stopped), resulting in the possibility of smudges and thus a loss in aesthetics. Hence, in the present disclosure, when the print stop instruction is received, printing is performed on a third predetermined section, the heating elements to which current conduction has stopped are then made to face a fourth predetermined section adjacent to the third predetermined section for a third predetermined amount of time, and subsequently printing is performed on a fifth predetermined section adjacent to the fourth predetermined section, thereby reducing the appearance of smudges. With this arrangement, it is possible to improve aesthetics.

BRIEF DESCRIPTION OF THE DRAWINGS

FIG. 1 is a perspective view showing the outer appearance of the tape printer related to embodiment 1 of the present disclosure.

FIG. 2 is a side cross-sectional view showing the internal structure of the tape printer.

FIG. 3 is a perspective view showing the outer appearance of the tape printer with the first, second, and frontward-side opening/closing covers open.

FIG. 4 is a perspective view showing the tape printer with the first, second, and frontward-side opening/closing covers open and the tape cartridge and ink ribbon cartridge removed.

FIG. 5 is a perspective view showing the overall configuration of the tape cartridge.

FIG. 6 is a perspective view showing the overall configuration of the ink ribbon cartridge.

FIG. 7 is a function block diagram showing the configuration of the control system of the tape printer.

FIG. 8 is a flowchart showing the control procedure executed by the print control portion of the CPU.

FIG. 9A is an explanatory view for explaining the pausing and restarting behavior in the production of a tape with print by a comparison example of the present disclosure.

FIG. 9B is an explanatory view for explaining the pausing and restarting behavior in the production of a tape with print by the comparison example.

FIG. 9C is an explanatory view for explaining the pausing and restarting behavior in the production of a tape with print by the comparison example.

FIG. 9D is an explanatory view for explaining the pausing and restarting behavior in the production of a tape with print by the comparison example.

FIG. 9E is an explanatory view for explaining the pausing and restarting behavior in the production of a tape with print by the comparison example.

FIG. 9F is an explanatory view for explaining the pausing and restarting behavior in the production of a tape with print by the comparison example.

FIG. 10A is an explanatory view for explaining the pausing and restarting behavior in the production of a tape with print by embodiment 1.

FIG. 10B is an explanatory view for explaining the pausing and restarting behavior in the production of a tape with print by embodiment 1.

FIG. 10C is an explanatory view for explaining the pausing and restarting behavior in the production of a tape with print by embodiment 1.

FIG. 10D is an explanatory view for explaining the pausing and restarting behavior in the production of a tape with print by embodiment 1.

FIG. 10E is an explanatory view for explaining the pausing and restarting behavior in the production of a tape with print by embodiment 1.

FIG. 10F is an explanatory view for explaining the pausing and restarting behavior in the production of a tape with print by embodiment 1.

FIG. 10G is an explanatory view for explaining the pausing and restarting behavior in the production of a tape with print by embodiment 1.

FIG. 11 is a conceptual view showing the relative positional relationship between the printing head and tape with print.

FIG. 12 is a flowchart showing the control procedure executed by the CPU.

FIG. 13A is an explanatory view for explaining the pausing and restarting behavior in the production of a tape with print by embodiment 2 of the present disclosure.

FIG. 13B is an explanatory view for explaining the pausing and restarting behavior in the production of a tape with print by embodiment 2 of the present disclosure.

FIG. 13C is an explanatory view for explaining the pausing and restarting behavior in the production of a tape with print by embodiment 2 of the present disclosure.

FIG. 13D is an explanatory view for explaining the pausing and restarting behavior in the production of a tape with print by embodiment 2 of the present disclosure.

FIG. 13E is an explanatory view for explaining the pausing and restarting behavior in the production of a tape with print by embodiment 2 of the present disclosure.

FIG. 13F is an explanatory view for explaining the pausing and restarting behavior in the production of a tape with print by embodiment 2 of the present disclosure.

FIG. 13G is an explanatory view for explaining the pausing and restarting behavior in the production of a tape with print by embodiment 2 of the present disclosure.

FIG. 14 is a conceptual view showing the relative positional relationship between the printing head and tape with print.

FIG. 15 is a flowchart showing the control procedure executed by the print control portion of the CPU.

FIG. 16A is an explanatory view for explaining the pausing and restarting behavior in the production of a tape with print in a modification wherein feeding is stopped in a section that is to become a blackened region and then, upon return, the blackened region is formed and filled in the forward direction.

FIG. 16B is an explanatory view for explaining the pausing and restarting behavior in the production of a tape with print in the modification.

FIG. 16C is an explanatory view for explaining the pausing and restarting behavior in the production of a tape with print in the modification.

FIG. 16D is an explanatory view for explaining the pausing and restarting behavior in the production of a tape with print in the modification.

FIG. 16E is an explanatory view for explaining the pausing and restarting behavior in the production of a tape with print in the modification.

FIG. 16F is an explanatory view for explaining the pausing and restarting behavior in the production of a tape with print in the modification.

FIG. 16G is an explanatory view for explaining the pausing and restarting behavior in the production of a tape with print in the modification.

FIG. 17 is a conceptual view showing the relative positional relationship between the printing head and tape with print.

FIG. 18 is a flowchart showing the control procedure executed by the print control portion of the CPU.

FIG. 19A is an explanatory view for explaining the pausing and restarting behavior in the production of a tape with print in a modification wherein a blackened region is formed both during through-down and through-up.

FIG. 19B is an explanatory view for explaining the pausing and restarting behavior in the production of a tape with print in the modification.

FIG. 19C is an explanatory view for explaining the pausing and restarting behavior in the production of a tape with print in the modification.

FIG. 19D is an explanatory view for explaining the pausing and restarting behavior in the production of a tape with print in the modification.

FIG. 19E is an explanatory view for explaining the pausing and restarting behavior in the production of a tape with print in the modification.

FIG. 19F is an explanatory view for explaining the pausing and restarting behavior in the production of a tape with print in the modification.

FIG. 19G is an explanatory view for explaining the pausing and restarting behavior in the production of a tape with print in the modification.

FIG. 20 is a conceptual view showing the relative positional relationship between the printing head and tape with print.

FIG. 21 is a flowchart showing the control procedure executed by the print control portion of the CPU.

FIG. 22A is an explanatory view for explaining the pausing and restarting behavior in the production of a tape with print in a modification wherein the take-up tension is released immediately before reverse feeding.

FIG. 22B is an explanatory view for explaining the pausing and restarting behavior in the production of a tape with print in the modification.

FIG. 22C is an explanatory view for explaining the pausing and restarting behavior in the production of a tape with print in the modification.

FIG. 22D is an explanatory view for explaining the pausing and restarting behavior in the production of a tape with print in the modification.

FIG. 22E is an explanatory view for explaining the pausing and restarting behavior in the production of a tape with print in the modification.

FIG. 22F is an explanatory view for explaining the pausing and restarting behavior in the production of a tape with print in the modification.

FIG. 22G is an explanatory view for explaining the pausing and restarting behavior in the production of a tape with print in the modification.

FIG. 23 is a flowchart showing the control procedure executed by the print control portion of the CPU.

DETAILED DESCRIPTION OF THE PREFERRED EMBODIMENTS

In the following, embodiments of the present disclosure will be described with reference to the accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to embodiment 1 of the present disclosure will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 comprises a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes the area above the frontward side of the first storage part 3.

A head holding body 10 is disposed in the interior of the first opening/closing cover 8*a* (refer to FIG. 3 as well). Then, the first opening/closing cover 8*a* pivots around the above described pivot axis K1, making it possible to move a printing head 11 (specifically, the thermal head) disposed on the head holding body 10 relatively closer to or farther away from a feeding roller 12 disposed on the housing main body 2*a*. Specifically, the first opening/closing cover 8*a* is capable of pivoting from a closed position (the states in FIGS. 1 and 2) in which the printing head 11 is close to the feeding roller 12, to an open position (the states in FIGS. 3 and 4) in which the printing head 11 is far away from the feeding roller 12.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes the area above the rearward side of the first storage part 3.

Then, the first opening/closing cover 8*a* and the second opening/closing cover 8*b* are configured so that, when each is closed, an outer circumference part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes the area above the third storage part 4.

Print-Receiving Tape Roll and Surrounding Area Thereof

At this time, as shown in FIG. 2, a tape cartridge TK is detachably mounted in a first predetermined position 13 below the frontward-side opening/closing cover 9 (when closed) of the housing main body 2*a*. This tape cartridge TK comprises a print-receiving tape roll R1 wound around and formed on an axis O1.

That is, the tape cartridge TK comprises the print-receiving tape roll R1 and a connecting arm 16, as shown in FIG. 5. The connecting arm 16 comprises a left and right pair of first bracket parts 20, 20 disposed on the rearward side, and a left and right pair of second bracket parts 21, 21 disposed on the frontward side.

The first bracket parts 20, 20 are set so as to sandwich the above described print-receiving tape roll R1 from both the left and right sides along the axis O1 via a left and right pair of substantially circular roll flange parts f1, f2, holding the print-receiving tape roll R1 rotatably around the axis O1 with the tape cartridge TK mounted to the housing main body 2*a*. These first bracket parts 20, 20 are connected by a first connecting part 22 that is extended substantially along the left-right direction on the upper end, avoiding interference with the outer diameter of the print-receiving tape roll R1.

The print-receiving tape roll R1 is rotatable when the tape cartridge TK is mounted in the interior of the housing main body 2*a*. The print-receiving tape roll R1 winds a print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The print-receiving tape roll R1 is received in the first storage part 3 from above by the mounting of the above described tape cartridge TK and stored with the axis O1 of the winding of the print-receiving tape 150 in the left-right direction. Then, the print-receiving tape roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upward side in FIG. 2) toward the other side (downward side in FIG. 2). The print-receiving layer 154 is a layer in which a desired print part 155 (refer to the enlarged partial view in FIG. 2) is formed by the heat transfer of ink from the above described printing head 11. The adhesive layer 152 is a layer for affixing the base layer 153 to a suitable adherent (not shown). The separation material layer 151 is a layer that covers the adhesive layer 152.

Feeding Roller and Printing Head

Returning to FIG. 2 and FIG. 4, the above described feeding roller 12 is disposed on a middle upward side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the print-receiving tape 150 fed out from the print-receiving tape roll R1 stored in the first storage part 3 in a tape posture in which the tape-width direction is in the left-right direction.

Further, the above described head holding part 10 disposed on the first opening/closing cover 8*a* comprises the above described printing head 11. The printing head 11, as described above, is capable of moving relatively closer to or farther away from the feeding roller 12 by the pivoting of the first opening/closing cover 8*a* around the pivot axis K1. That is, the printing head 11 moves closer to the feeding roller 12 when the first opening/closing cover 8*a* is closed, and farther away from the feeding roller 12 when the first opening/closing cover 8*a* is opened. This printing head 11 is disposed in a position of the head holding part 10 that faces the area above the feeding roller 12, with the first opening/closing cover 8*a* closed, sandwiching the print-receiving tape 150 fed by the feeding roller 12 in coordination with the feeding roller 12. Accordingly, when the first opening/closing cover 8*a* is closed, the printing head 11 and the feeding roller 12 are disposed facing each other in the up-down direction. Then, the printing head 11 forms the above described print part 155 on the print-receiving layer 154 of the print-receiving tape 150 sandwiched between the printing head 11 and the feeding roller 12 using an ink ribbon IB of an ink ribbon cartridge RK described later, thereby forming a tape 150' with print.

Ink Ribbon Cartridge

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. FIG. 6 shows the detailed structure of the ink ribbon cartridge RK.

As shown in FIG. 6, the ink ribbon cartridge RK comprises a cartridge housing 80, a ribbon feed-out roll R4 which has wound the unused ink ribbon IB in manner that enables feed-out, and a ribbon take-up roll R5. The cartridge housing 80 comprises a rearward-side feed-out roll storage part 81, a frontward-side take-up roll storage part 82, and a coupling part 83 that couples both of these storage parts 81, 82. The coupling part 83 couples the above described take-up roll storage part 82 and the above described feed-out roll storage part 81 while exposing the above described ink ribbon IB fed out from the ribbon feed-out roll R4 to the outside of the cartridge housing 80.

The feed-out roll storage part 81 is configured by combining a substantially semi-cylindrical upper part 81*a* and lower part 81*b*. The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for print formation by the printing head 11.

The take-up roll storage part 82 is configured by combining a substantially semi-cylindrical upper part 82*a* and lower part 82*b*. The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the printing head 11 side of the print-receiving tape 150 sandwiched between the printing head 11 and the feeding roller 12, contacting the area below the printing head 11. Then, current is conducted to the heating elements corresponding to the entire width-direction region of the ink ribbon IB to perform printing on the print-receiving tape 150. After the ink of the ink ribbon IB is thus transferred to the print-receiving layer 154 of the print-receiving tape 150 by the heat from the printing head 11 and print formation is executed, the used ink ribbon IB is taken up on the ribbon take-up roll R5.

Separation Material Roll and Surrounding Area Thereof

As shown in FIG. 5, the connecting arm 16 of the tape cartridge TK comprises a peeling part 17 that includes a substantially horizontal slit shape, for example. This peeling part 17 is an area that peels the separation material layer 151 from the tape 150' with print fed out from the print-receiving tape roll R1 and fed to the frontward side. As shown in FIG. 2, the above described peeling part 17 peels the above described separation material layer 151 from the tape 150' with print on which print was formed as described above, thereby separating the separation material layer 151 and a tape 150" with print made of the other layers, i.e., the print-receiving layer 154, the base layer 153, and the adhesive layer 152.

The tape cartridge TK, as shown in FIG. 2 and FIG. 5, comprises a separation material roll R3 formed by winding the above described peeled separation material layer 151 around an axis O3. That is, the separation material roll R3 is received in the above described second storage part 5 from above by the mounting of the aforementioned tape cartridge TK and stored with the axis O3 for winding the separation material layer in the left-right direction. Then, the separation material roll R3, stored in the second storage part 5 (with the tape cartridge TK mounted), is driven by a separation sheet take-up motor M3 disposed inside the housing main body 2*a* via a gear mechanism (not shown) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so that the above described separation material roll R3 is sandwiched from both the left and right sides along the axis O3, holding the separation material roll R3 rotatably around the axis O3 with the tape cartridge TK mounted to the housing main body 2*a*. These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are connected by a left and right pair of roll connecting beam parts 24, 24.

Further, FIG. 5 shows the state before the separation material layer 151 is wound around the axis O3 and the separation material roll R3 is formed (the case of the unused tape cartridge TK). That is, FIG. 5 shows substantially circular roll flange parts f3, f4 disposed so as to sandwich both width-direction sides of the separation material layer 151, and conveniently denotes the location where the separation material roll R3 is formed using the reference number "R3."

Tape Roll with Print and Surrounding Area Thereof

On the other hand, as shown in FIG. 2 and FIG. 4, a take-up mechanism 40 comprising a winding core 41 for sequentially winding the above described tape 150" with print is received in the above described third storage part 4 from above. The take-up mechanism 40 is stored so that the above described winding core 41 is supported rotatably around an axis O2 of the winding of the tape 150" with print, with the axis O2 in the left-right direction. Then, with the take-up mechanism 40 stored in the third storage part 4, the winding core 41 is driven by an adhesive take-up motor M2 that is disposed in the interior of the housing main body 2*a* via a gear mechanism (not shown) and rotates in a predetermined rotating direction (a direction B in FIG. 2) inside the third storage part 4, sequentially taking up and layering the tape 150" with print on the outer circumference part of the winding core 41. With this arrangement, the tape 150" with print is sequentially wound around the outer circumference side of the winding core 41, forming a tape roll R2 with print.

Cutter Mechanism 30

Further, as shown in FIG. 2, a cutter mechanism 30 is disposed on the downstream side of the printing head 11 and the upstream side of the tape roll R2 with print, along the tape transport direction.

The cutter mechanism 30, while not shown in detail, comprises a movable blade and a carriage that supports the movable blade and is capable of travelling in the tape-width direction (in other words, the left-right direction). Then, the carriage travels by the driving of a cutter motor MC (refer to FIG. 7 described later) and the movable blade moves in the tape-width direction, cutting the above described tape 150" with print in the width direction.

Overview of Operation of Tape Printer

Next, an overview of the operation of the tape printer 1 with the above described configuration will be described.

That is, when the tape cartridge TK is mounted in the above described first predetermined position 13, the print-receiving tape roll R1 is stored in the first storage part 3 positioned on the rearward side of the housing main body 2*a*, and the axis O3 side that forms the separation material roll R3 is stored in the second storage part 5 positioned on the frontward side of the housing main body 2*a*. Further, the take-up mechanism 40 for forming the tape roll R2 with print is stored in the third storage part 4 positioned on the frontward side of the housing main body 2*a*.

In this state, the user manually peels the separation material layer 151 from the print-receiving tape 150 (printing has not yet begun at this point in time), and attaches the tip end of the tape made of the base layer 153 and the adhesive layer 152 to the winding core 41 of the above described take-up mechanism 40. Then, when the feeding roller 12 is driven, the print-receiving tape 150 fed out by the rotation of the print-receiving tape roll R1 stored in the first storage part 3 is fed to the frontward side. Then, the above described print part 155 (specifically configured by an image IM, a blackened region Q, and the like described later) is formed by the printing head 11 on the print-receiving layer 154 of the fed print-receiving tape 150, forming a tape 150' with print. When the tape 150' with print on which print was formed is further fed to the frontward side and fed to the peeling part 17, the separation material layer 151 is peeled at the peeling part 17, forming the tape 150" with print. The peeled separation material layer 151 is fed to the downward side, introduced to and wound inside the second storage part 5, forming the separation material roll R3.

On the other hand, the tape 150" with print from which the separation material layer 151 has been peeled is further fed to the frontward side, introduced to the third storage part 4, and wound around the outer circumference side of the winding core 41 of the take-up mechanism 40 inside the third storage part 4, thereby forming the tape roll R2 with print. At this time, the cutter mechanism 30 disposed on the transport direction downstream side (that is, the frontward side) cuts the tape 150" with print. With this arrangement, the tape 150" with print wound around the tape roll R2 with print can be cut based on a timing preferred by the user and the tape roll R2 with print can be removed from the third storage part 4 after cutting.

Note that, at this time, although not explained by illustration, a non-adhesive tape (one without the above described adhesive layer 152 and separation material layer 151) may be wound around the print-receiving tape roll R1. In this case as well, the print-receiving tape roll R1 which winds the non-adhesive tape is received in the first storage part 3 from above by the mounting of the tape cartridge TK and stored with the axis O1 of the winding of the non-adhesive tape in the left-right direction. Then, the print-receiving tape roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the tape roll R2 with print and a side toward the discharging exit (not shown) may be disposed. That is, the non-adhesive tape after print formation (or the tape 150" with print) may be discharged as is from the discharging exit (not shown) disposed on the second opening/closing cover 8*b* side, for example, of the housing 2 to the outside of the housing 2 without being wound inside the third storage part 4 as described later by switching the tape path by a switch operation of the shoot 15 using a switch lever (not shown).

Control System

Next, the control system of the tape printer 1 will be described using FIG. 7. In FIG. 7, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the winding core 41 of the above described take-up mechanism 40, a motor driving circuit 220 that controls the driving of the above described separation sheet take-up motor M3 that drives the above described separation material roll R3, a printing head control circuit 221 that controls the current conduction of the heating elements (not shown) of the above described printing head 11, a motor driving circuit 222 that controls the driving of the cutter motor MC that causes the carriage comprising the above described movable blade to travel, a display part 215 that performs suitable displays, and an operation part 216 that permits suitable operation input by the user. Further, while the CPU 212 is connected to a PC 217 serving as an external terminal in this example, the CPU 212 does not need to be connected in a case where the tape printer 1 operates alone (a so-called all-in-one type).

The ROM 214 stores control programs for executing predetermined control processing (including programs that execute the flow processing in FIG. 8, FIG. 12, FIG. 15, FIG. 18, FIG. 21, and FIG. 23 described later). The RAM 213 comprises an image buffer 213*a* that expands print data (refer to step S204 described later) generated in correspondence with an operation of the above described operation part 216 (or the PC 217) by an operator into dot pattern data for printing in a predetermined print area of the above described print-receiving layer 154, and stores the data, for example. The CPU 212 repeatedly prints one image (hereinafter suitably referred to as "unit print image") corresponding to the above described dot pattern data stored in the image buffer 213*a* on the print-receiving tape 150 by the printing head 11 while feeding out the print-receiving tape 150 by the feeding roller 12, based on the above described control programs.

Cooling

Hence, in this embodiment, so-called cooling is executed in order to suppress the overheating of the printing head 11 resulting from continuous movement, pausing print formation. That is, as shown in FIG. 7, in the tape printer 1 of this embodiment, a temperature sensor SR that detects the temperature of the printing head 11 is disposed and connected to the CPU 212. At this time, the CPU 212 functionally comprises a print control portion 212A and a cooling control portion 212B. The print control portion 212A executes each of the procedures of the flow in FIG. 8 described later, thereby controlling the printing head 11, the feeding roller 12, the cutter mechanism 30, and the like in coordination with each other. The cooling control portion 212B outputs a pause instruction signal (details described later) to the print control portion 212A based on the detection result of the above described temperature sensor SR.

Processing Content of Cooling Control

FIG. 8 shows a flowchart indicating the processing content executed by the above described cooling control portion 212B. In FIG. 8, the cooling control portion 212B of the CPU 212 first, in step S110 and step S120, sets a print stop temperature T1 at which print formation by the printing head 11 is stopped, and a restart temperature T2 for restarting print formation once again after it stops, respectively. For these settings, values stored in suitable storage means in advance may be read and stored in the RAM 213, or values corresponding to an operation of the operation part 216 (or the above described PC 217) by the user may be acquired and stored in the RAM 213. Subsequently, the flow proceeds to step S130.

In step S130, the cooling control portion 212B determines whether or not a temperature T of the printing head 11 is at least the above described print stop temperature T1 (if $T \geq T1$), based on the detection result of the above described temperature sensor SR. During the period $T < T1$, the condition of step S130 is not satisfied (S130: NO), and the flow loops back and enters a standby state. Once T≥T1, the condition of step S130 is satisfied (S130: YES), and the flow proceeds to step S140.

In step S140, the cooling control portion 212B outputs the aforementioned pause instruction signal to the print control portion 212A. As a result, pause control of tape feeding and print formation by the print control portion 212A is performed.

Subsequently, in step S150, the cooling control portion 212B determines whether or not the temperature T of the printing head 11 is the above described restart temperature T2 or less (if T≤T2), based on the detection result of the above described temperature sensor SR. During the period T>T2, the condition of step S150 is not satisfied (S150: NO), and the flow loops back and enters a standby state. Once T≤T2, the condition of step S150 is satisfied (S150: YES), and the flow proceeds to step S160.

In step S160, the cooling control portion 212B outputs a production restart instruction signal (details described later) to the print control portion 212A. As a result, as described later, control that restarts the tape feeding and print formation by the print control portion 212A is performed. Subsequently, this process terminates here.

Special Characteristic of Embodiment 1

The special characteristic of this embodiment configured as described above lies in the technique for reducing the appearance of smudges (a pseudo-printing section G described later) that may occur on the print-receiving tape 150 by the remaining heat in the printing head 11 when the print formation movement is stopped by execution of the above described cooling during printing movement. The following specifically describes the details while using a comparison example.

Comparison Example

The following describes in detail the behavior by which the above described smudges occur using the comparison example shown in FIGS. 9A-9F. As described above, in the tape printer 1, the above described unit print image (a specific character string translated into an image or one image that includes a specific visual object) is repeatedly formed in a plurality along the transport direction, thereby producing the above described tape 150" with print. First, FIG. 9A shows the state immediately after feed-out of the print-receiving tape 150 from the print-receiving tape roll R1 has been started. In the state shown, the tip end of the print-receiving tape 150 has not yet arrived at the position of the printing head 11, and formation of the image IM (including the text "Thank you" and border lines on both width-direction sides in this example) on the print-receiving tape 150 by the printing head 11 has not started.

When the feeding of the print-receiving tape 150 (in other words, the feeding of the tapes 150', 150" with print; hereinafter suitably simply referred to as "the feeding of the print-receiving tape 150") further advances from this state at a predetermined constant speed, the print-receiving tape 150 arrives at the position of the printing head 11, and print formation of the above described image IM (specifically, a first image IM1) is started (refer to FIG. 9B and FIG. 9C). When formation of one image IM1 ends, formation of the following image IM2 is started next using the same dot pattern data (refer to FIG. 9D). In this manner, image IM1, image IM2, image IM3, . . . which have the same content, are sequentially formed on the print-receiving tape 150, producing the tape 150" with print. Note that hereinafter, in cases where the above described image IM1, image IM2, image IM3, . . . and the like are described without any particular distinction, the image will suitably be simply expressed as "the image IM."

Pausing of Feeding and Printing Due to Cooling

Hence, if cooling has been executed due to the high temperature of the printing head 11 as described above, the feeding of the print-receiving tape 150 by the above described feeding roller 12 and the print formation on the print-receiving tape 150 by the printing head 11 are paused (under the premise of subsequent restarting). In the example shown, execution of the above described cooling is started in the state shown in FIG. 9D and, once the feeding speed of the above described print-receiving tape 150 has decelerated along a predetermined deceleration pattern (defined in a fixed manner with respect to the above described predetermined constant speed, for example), the feeding is finally stopped immediately after print formation of the text characters "Thank you" in the above described image IM2 in this example (refer to FIG. 9E). Note that while print formation by the above described printing head 11 (in other words, current conduction to the heating elements) is simultaneously controlled (so-called through-down control) according to this deceleration, this need only be performed by a known technique, and therefore a detailed description thereof is omitted.

Subsequently, when the cooling is canceled by a temperature decrease in the printing head 11 after a predetermined amount of time has passed, the feeding of the above described print-receiving tape 150 and the above described print formation are restarted (refer to FIG. 9F). That is, after the feeding speed of the above described print-receiving tape 150 has accelerated along a predetermined acceleration pattern (defined in a fixed manner with respect to the above described predetermined constant speed, for example), the speed is set as the above described predetermined constant speed. Note that while print formation by the above described printing head 11 (in other words, current conduction to the heating elements) is simultaneously controlled (so-called through-up control) according to this acceleration, this need only be performed by a known technique, and therefore a detailed description thereof is omitted.

In this comparison example, when cooling is performed and feeding and print formation are stopped as described above, with current conduction stopped as shown in the above described FIG. 9E, the remaining heat in the printing head 11 that is high in temperature may cause formation of the pseudo-printing section G on the print-receiving tape 150 (even though current conduction is stopped). As a result, after feeding is restarted as in the above described FIG. 9F, the above described pseudo-printing section G may become a smudge, causing a loss in aesthetics.

Details of Technique of Embodiment 1

The following describes the technique of this embodiment for resolving the above, using FIG. 10. That is, in this embodiment, the flow passes through the states shown in FIGS. 10A-10C, which are the same as those in FIGS. 9A-9C, and, in a case where the above described pause instruction is performed immediately after print formation of the text character "T" in the image IM2 in the same manner as described above in FIG. 10D, deceleration is not simply started to stop the feeding as in the above described comparison example, but rather the feeding is stopped while the blackened region Q is formed into print in the border area between the image IM2 and the following image IM3 that is to be formed next. That is, feeding is stopped with the printing head 11 positioned in the blackened region Q (refer to FIG. 10E). Then, even when feeding is subsequently restarted, print formation of the blackened region Q continues as shown in FIG. 10F. Note that FIG. 11 is a view conceptually showing the relative positional relationship between the printing head 11 and the tape 150" with print at this time.

According to the above described behavior, at the time cooling is canceled and feeding and print formation are restarted, the pseudo-printing section G that occurs on the tape 150" with print when feeding is stopped due to cooling is embedded in the above described blackened region Q, as shown in FIG. 10G. As a result, it is possible to suppress the effect on the outer appearance of the tape 150" with print to a minimum, and thus improve aesthetics.

Note that while, in this example, after print formation of the image IM2 has been completed after the above described deceleration, feeding is stopped while the blackened region Q is formed into print in the border area with the following image IM3 to be formed next, the present disclosure is not limited thereto. That is, the feeding may be stopped by the above described deceleration while the blackened region Q is formed into print in the middle of print formation of the image IM2 (the same holds true for embodiment 2 and each modification described later as well).

Further, while the blackened region Q is a print region resulting from so-called full dot printing in the above described example, the color is not limited to black and may be a color other than black as long as the pseudo-printing section G can be embedded. Further, the printing is not limited to full dot printing and may be shaded printing, a zebra pattern, a checkered pattern, a hatch pattern, or the like in which the number of dots is thinned to a certain extent, and further may be a technique that conceals the pseudo-printing section G by a listing of a great number of text characters, logos, or visual objects, or the like (the same holds true for embodiment 2 and each modification described later as well).

Content of Control Processing

The following describes the processing content executed by the print control portion 212A of the CPU 212 for achieving the above described technique, using the flow in FIG. 12. In FIG. 12, the flow is started by the user turning ON the power of the tape printer 1, for example ("START" position).

First, in step S202, the print control portion 212A determines whether or not a production start instruction signal for the above described tape 150" with print corresponding to a production start operation of the operation part 216 (or the above described PC 217) by the user has been input. If the above described production start instruction signal corresponding to the production start intention of the user has not been input, the condition of step S202 is not satisfied (S202: NO), and the flow loops back and enters a standby state. If the above described production start instruction signal has been input, the condition of step S202 is satisfied (S202: YES), and the flow proceeds to step S203.

In step S203, the print control portion 212A determines whether or not total length data indicating the total length along the transport direction of the above described tape 150" with print to be produced, corresponding to an operation of the operation part 216 (or the above described PC 217) by the user, has been input. If the above described total length data corresponding to the tape total length intended by the user has not been input, the condition of step S203 is not satisfied (S203: NO), the flow returns to the above described step S202, and the same procedure is repeated. If the above described total length data has been input, the condition of step S203 is satisfied (S203: YES), and the flow proceeds to step S204.

In step S204, the print control portion 212A determines whether or not print data corresponding to one image IM (refer to FIG. 9, FIG. 10, and the like) to be repeatedly formed into print on the above described print-receiving tape 150 has been input based on an operation of the operation part 216 (or the above described PC 217) by the user.

If the print data has not been input, the condition of step S204 is not satisfied (S204: NO), the flow returns to the above described step S202, and the same procedure is repeated. If the above described print data has been input, the condition of step S204 is satisfied (S204: YES), and the flow proceeds to step S205.

Subsequently, in step S205, the print control portion 212A outputs a control signal to the motor driving circuits 218, 219, 220, starts the driving of the feeding motor M1, the adhesive take-up motor M2, and the separation sheet take-up motor M3, and starts the feeding of the above described print-receiving tape 150, the tape 150' with print, and the tape 150" with print (hereinafter, suitably simply referred to as "tape feeding") as well as the take-up of the above described tape 150" with print.

Then, in step S215, the print control portion 212A determines whether or not the above described tape feeding has arrived where the printing head 11 faces the corresponding print start position by a known technique, based on the print data acquired in the above described step S204. If the tape feeding has not arrived at the print start position, the condition is not satisfied (S215: NO), and the flow loops back and enters a standby state until this condition is satisfied. If the feeding has arrived at the print start position, the condition is satisfied (S215: YES), and the flow proceeds to step S220.

In step S220, the print control portion 212A outputs a control signal to the printing head control circuit 221, and current is conducted to the heating elements of the printing head 11, thereby starting the repeated print formation of the above described image IM (refer to FIG. 9, FIG. 10, and the like) on the above described print-receiving tape 150. Subsequently, the flow proceeds to step S224.

In step S224, the print control portion 212A determines whether or not the above described pause instruction signal from the above described cooling control portion 212B (refer to step S140 in the above described FIG. 8) has been input. If the above described pause instruction signal has not been input, the condition of step S224 is not satisfied (S224: NO), and the flow proceeds to step S300 described later. If the above described pause instruction signal has been input, the condition of step S224 is satisfied (S224: YES), and the flow proceeds to step S225.

In step S225, the print control portion 212A outputs a control signal to the motor driving circuits 218, 219, 220 based on the pause instruction signal input in the above described step S224, controls the driving of the feeding motor M1, the adhesive take-up motor M2, and the separation sheet take-up motor M3 in accordance with the above described deceleration pattern, and starts the deceleration of the above described tape feeding.

In step S230, the print control portion 212A determines whether or not the above described tape feeding has arrived where the printing head 11 faces the start position (transport-direction downstream-side end) of the above described blackened region Q in the border area between the two adjacent images IM, IM by a known technique, based on the print data acquired in the above described step S204. During the period in which the feeding has not arrived at the start position of the above described blackened region Q, the condition of step S230 is not satisfied (S230: NO), and the flow loops back and enters a standby state until the condition of step S230 is satisfied. If the feeding has arrived at the start position of the above described blackened region Q, the condition of step S230 is satisfied (S230: YES), and the flow proceeds to step S235.

In step S235, the print control portion 212A outputs a control signal to the printing head control circuit 221, and current is conducted to the heating elements of the printing head 11, thereby starting the print formation of the blackened region Q on the above described print-receiving tape 150. Note that the print data for forming the blackened region Q at this time is stored in the RAM 213 in advance, for example.

Subsequently, in step S240, the print control portion 212A determines whether or not the above described tape feeding has arrived where the printing head 11 faces the center position of the above described blackened region Q by a known technique, based on the print data acquired in the above described step S204. During the period in which the feeding has not arrived at the center position of the above described blackened region Q, the condition of step S240 is not satisfied (S240: NO), and the flow loops back and enters a standby state until the condition of step S240 is satisfied. Once the feeding has arrived at the center position of the above described blackened region Q, the condition of step S240 is satisfied (S240: YES), and the flow proceeds to step S245.

In step S245, the print control portion 212A outputs a control signal to the motor driving circuits 218, 219, 220 and the printing head control circuit 221, and stops the driving of the feeding motor M1, the adhesive take-up motor M2, and the separation sheet take-up motor M3, thereby stopping the tape feeding and current conduction to the heating elements of the above described printing head 11 as well as print formation of the above described blackened region Q.

Subsequently, in step S250, the print control portion 212A determines whether or not the production restart instruction signal from the above described cooling control portion 212B (refer to step S160 in the above described FIG. 8) has been input. During the period in which the above described production restart instruction signal is not input, the condition of step S250 is not satisfied (S250: NO), and the flow loops back and enters a standby state until the condition of step S250 is satisfied. If the above described production restart instruction signal has been input, the condition of step S250 is satisfied (S250: YES), and the flow proceeds to step S255.

In step S255, the print control portion 212A outputs a control signal to the motor driving circuits 218, 219, 220, controls the driving of the feeding motor M1, the adhesive take-up motor M2, and the separation sheet take-up motor M3 in accordance with the above described acceleration pattern, and restarts the above-described tape feeding and the take-up of the above described tape 150" with print, accelerating the speed. Additionally, the print control portion 212A, similar to the above described step S235, outputs a control signal to the printing head control circuit 221, conducts current to the heating elements of the printing head 11, and restarts print formation of the above described blackened region Q. Note that the print data for forming the blackened region Q at this time is stored in the RAM 213 in advance, for example. Subsequently, the flow proceeds to step S260.

In step S260, the print control portion 212A determines whether or not the above described tape feeding has arrived where the printing head 11 faces the end position (transport-direction upstream-side end) of the above described blackened region Q by a known technique, based on the print data acquired in the above described step S204. During the period in which the feeding has not arrived at the end position of the above described blackened region Q, the condition of step S260 is not satisfied (S260: NO), and the flow loops back and enters a standby state until the condition of step S260 is satisfied. If the feeding has arrived at the end position of the above described blackened region Q, the condition of step S260 is satisfied (S260: YES), and the flow proceeds to step S265.

In step S265, the print control portion 212A, similar to the above described step S245, outputs a control signal to the printing head control circuit 221, and stops conducting current to the heating elements of the printing head 11 and print formation of the above described blackened region Q.

In step S300, the print control portion 212A determines whether or not the above described tape feeding has arrived where the printing head 11 faces an all print end position where print formation of all of the above described images IM ends by a known technique, based on the total length data acquired in the above described step S203 and the print data acquired in step S204. If the tape feeding has not arrived at the all print end position, the condition is not satisfied (S300: NO), the flow returns to the step S220, and the same procedure is repeated. As are result, the aforementioned formation of the image IM continues. On the other hand, if the tape feeding has arrived at the print end position, the condition is satisfied (S300: YES), and the flow proceeds to step S305.

In step S305, the print control portion 212A outputs a control signal to the printing head control circuit 221, and stops conducting current to the heating elements of the printing head 11 and print formation (formation of the print part 155) on the above described print-receiving tape 150. At this time, the tape feeding is continually performed. With this arrangement, a blank state where the print part 155 does not exist is thereafter formed on the tape 150' with print. Subsequently, the flow proceeds to step S310.

In step S310, the print control portion 212A determines whether or not the above described tape feeding has arrived at the cutting position by the above described cutter mechanism 30 (a cutting position such as where the total length along the transport direction of the tape 150" with print wound as the tape roll R2 with print on the winding core 41 becomes the length intended by the operator), in accordance with the total length data acquired in the above described step S203. If the feeding has not arrived at the cutting position, the condition is not satisfied (S310: NO), and the flow loops back and enters a standby state. If the feeding has arrived at the cutting position, the condition is satisfied (S310: YES), and the flow proceeds to step S315.

In step S315, the print control portion 212A outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print (including the above described tape 150-0 as well) is stopped.

Subsequently, in step S320, the print control portion 212A outputs a control signal to the motor driving circuit 222, drives the above described cutter motor MC, and cuts the tape 150" with print by the operation of the above described cutter mechanism 30.

Then, the flow proceeds to step S325 where the print control portion 212A outputs a control signal to the motor driving circuit 219, starts the driving of the adhesive take-up motor M2, and takes up the tape 150" with print on the outer circumference part of the winding core 41 of the take-up mechanism 40.

Subsequently, in step S330, the print control portion 212A determines whether or not a predetermined amount of time has passed since the cutting operation of the cutter mechanism 30 in the above described step S320. If the predetermined amount of time has not passed, the condition is not satisfied (S330: NO), and the flow loops back and enters a standby state. This predetermined amount of time may be an amount of time for sufficiently taking up the tape 150" with print on the winding core 41. If the predetermined amount of time has passed, this condition is satisfied (S330: YES), and the flow proceeds to step S335.

In step S335, the print control portion 212A outputs a control signal to the motor driving circuit 219 and stops the driving of the adhesive take-up motor M2. With this arrangement, it is possible to reliably take up the tape 150" with print generated by the above described cutting on the tape roll R2 with print. This flow then terminates here.

According to this embodiment configured as described above, during cooling execution, the feeding of the tape is stopped while forming the blackened region Q, stopping the feeding with the printing head 11, to which current conduction is stopped, facing the inside of the blackened region Q. With this arrangement, even if the pseudo-printing section G occurs on the tape 150" with print by the remaining heat in the printing head 11, it is possible to embed within the above described blackened region Q and reduce the appearance of the smudges. As a result, it is possible to improve aesthetics.

Further, in particular, according to this embodiment, formation of the blackened region Q by full dot printing is performed. In particular, current is conducted to the above described heating elements corresponding to the entire width-direction region of the ink ribbon IK, forming the blackened region Q across substantially the entire tape-width region. With this arrangement, the pseudo-printing section G is reliably embedded by the blackened region Q, making apparent elimination possible. As a result, it is possible to reliably improve aesthetics.

Further, in particular, according to this embodiment, cooling is executed if the temperature of the printing head 11 rises to the predetermined print stop temperature T1, making it possible to suppress a decrease in durability in the printing head 11.

Embodiment 2

Next, embodiment 2 of the present disclosure will be described based on FIGS. 13-15. Note that components identical to those in the above described embodiment 1 are denoted using the same reference numerals, and descriptions thereof will be omitted or simplified as appropriate. According to this embodiment, after the same blackened region Q as that in the above is first completed to the end edge (the transport-direction upstream-side end), the tape is fed in the reverse direction, the printing head 11 is made to face the substantial center of the blackened region Q, and then feeding is stopped.

That is, according to this embodiment, the flow passes through the states respectively shown in FIGS. 13A-13C, which are the same as those in the above described FIGS. 10A-10D, tape feeding is stopped after the blackened region Q is first formed into print in the above described image border area and the transport direction is subsequently turned back as shown in FIG. 13D, and then tape feeding is performed in the reverse direction until the printing head 11 faces the center position of the blackened region Q and then stopped with the printing head 11 facing that position as shown in FIG. 13E. Then, when feeding is subsequently restarted, the tape feeding is performed once again in the forward direction, as shown in FIG. 13F. Note that FIG. 14 is a view conceptually showing the relative positional relationship between the printing head 11 and the tape 150" with print at this time.

As described above, since the printing head 11 is positioned inside the blackened region Q at the time feeding and print formation are stopped due to cooling execution, when the cooling is canceled and feeding and print formation are then restarted, the pseudo-printing section G that occurs on the tape 150" with print during the above described stopping is embedded in the blackened region Q that was first formed, reliably making the pseudo-printing section G no longer visible, as shown in FIG. 13G. As a result, it is possible to suppress the effect on the outer appearance of the tape 150" with print to a minimum, and thus improve aesthetics.

Content of Control Processing

The following describes the processing content executed by the print control portion 212A of the CPU 212 for achieving the above described technique in this embodiment, using the flow in FIG. 15.

The flow shown in FIG. 15 differs in that step S236, step S237, and step S238 are newly disposed between step S235 and step S240 in FIG. 12, step S249 is disposed in place of step S245, and step S270 is disposed in place of step S255, step S260, and step S265.

That is, the flow passes through the same steps S202-S235 as described above and, in the newly disposed step S236, the print control portion 212A determines whether or not the above described tape feeding has arrived where the printing head 11 faces the end position (transport-direction upstream-side end) of the above described blackened region Q by a known technique, based on the print data acquired in the above described step S204. During the period in which the feeding has not arrived at the end position of the above described blackened region Q, the condition of step S236 is not satisfied (S236: NO), and the flow loops back and enters a standby state until the condition of step S236 is satisfied. If the feeding has arrived at the end position of the above described blackened region Q, the condition of step S236 is satisfied (S236: YES), and the flow proceeds to step S237. Note that the print data for forming the blackened region Q at this time is stored in the RAM 213 in advance, for example.

In step S237, the print control portion 212A, similar to the above described step S265, outputs a control signal to the printing head control circuit 221, controls the current conduction to the heating elements of the printing head 11, and stops print formation of the above described blackened region Q.

Subsequently, in step S238, the print control portion 212A outputs a control signal to the motor driving circuits 218, 219, 220, controls the driving of the feeding motor M1, the adhesive take-up motor M2, and the separation sheet take-up motor M3, and starts tape feeding in the reverse direction. Subsequently, after the print control portion 212A has determined whether or not the tape feeding has arrived at the center position of the above described blackened region Q in the same step S240 as described above, the flow proceeds to the newly disposed step S249.

In step S249, the print control portion 212A outputs a control signal to the motor driving circuits 218, 219, 220, controls the driving of the feeding motor M1, the adhesive take-up motor M2, and the separation sheet take-up motor M3, and stops the above described tape feeding. Subsequently, after the print control portion 212A has determined whether or not a production restart instruction signal from the cooling control portion 212B has been input in the same step S250 as described above, the flow proceeds to the newly disposed step S270.

In step S270, the print control portion 212A outputs a control signal to the motor driving circuits 218, 219, 220, controls the driving of the feeding motor M1, the adhesive take-up motor M2, and the separation sheet take-up motor M3 in accordance with the aforementioned acceleration pattern, and restarts the above-described tape feeding in the forward direction and the take-up of the above described tape 150" with print, accelerating the speed. Subsequently, the flow proceeds to step S300. The steps S300-S335 thereafter are the same as those in the above described FIG. 12, and descriptions thereof will be omitted.

According to this modification as well, the same advantages as those of the above described embodiment 1 are achieved. That is, during cooling execution, after the blackened region Q is first formed, tape feeding is performed in the reverse direction and stopped when the printing head 11 is in the substantial center of the blackened region Q, stopping the feeding with the printing head 11, to which current conduction is stopped, facing the substantial center. With this arrangement, even if the pseudo-printing section G occurs on the tape 150" with print by the remaining heat in the printing head 11, it is possible to embed within the above described blackened region Q previously formed and reduce the appearance of the smudges. As a result, it is possible to improve aesthetics.

Note that the present disclosure is not limited to the above described embodiment, and various modifications may be made without deviating from the spirit and scope of the disclosure. The following describes such modifications one by one. Note that components identical to those in the above described embodiment are denoted using the same reference numerals, and descriptions thereof will be omitted or simplified as appropriate.

(1) When Feeding is Stopped at the Section That is to Become the Blackened Region and Then, Upon Return, the Blackened Region is Formed and Filled in the Forward Direction In this modification, after the printing head 11 is made to face the substantial center of the region that is to become the above described blackened region Q and then stopped, feeding is turned back to the reverse direction, and then the blackened region Q is formed along the forward direction.

That is, according to this modification, the flow passes through the states respectively shown in FIGS. 16A-16C, which are the same as those in FIG. 10A-10D, the print-receiving tape 150 is fed in the forward direction until the printing head 11 faces the center of the image boundary area (after printing has stopped immediately before the printing head 11 arrives at the center of the above described image border area) as shown in FIG. 16D, and then tape feeding is stopped with the printing head 11 facing the center. Then, when feeding is subsequently restarted, first tape feeding is performed in the reverse direction until the printing head 11 faces the tip end (transport-direction downstream-side end) position of the above described blackened region Q, as shown in FIG. 16E. At this time, due to the above described stopping of tape feeding, the pseudo-printing section G is formed by the remaining heat of the printing head 11 in the center of the above described image border area. Subsequently, as shown in FIG. 16F, the blackened region Q is formed into print by the printing head 11 while tape feeding is turned back and performed once again in the forward direction. Note that FIG. 17 is a view conceptually showing the relative positional relationship between the printing head 11 and the tape 150" with print at this time.

With the above, at the time feeding and print formation are stopped due to cooling execution, even if the pseudo-printing section G occurs on the tape 150" with print, when feeding is performed in the reverse direction and further in the forward direction after cooling is canceled, overwriting is performed so that the pseudo-printing section G that occurs on the tape 150" with print during the above described stopping is filled in by the blackened region Q formed during the above described through-up, making it possible to reliably make the pseudo-printing section G no longer visible, as shown in FIG. 16G. As a result, it is possible to suppress the effect on the outer appearance of the tape 150" with print to a minimum, and thus improve aesthetics.

Content of Control Processing

The following describes the processing content executed by the print control portion 212A of the CPU 212 for achieving the above described technique in this modification, using the flow in FIG. 18.

The flow shown in FIG. 18 differs in that steps S230-S238 in FIG. 15 are omitted, and step S252, step S253, step S254, step S260, and step S265 are disposed in place of step S270 in FIG. 15.

That is, after passing through the same steps S202-S225 as described above, the flow further passes through the same steps S240-S250 as described above and then proceeds to the newly disposed step S252. In step S252, the print control portion 212A outputs a control signal to the motor driving circuits 218, 219, 220, controls the driving of the feeding motor Ml, the adhesive take-up motor M2, and the separation sheet take-up motor M3, and starts tape feeding in the reverse direction, in the same manner as in step S238 in the above described FIG. 15.

Subsequently, in step S253, the print control portion 212A determines whether or not the above described tape feeding has arrived where the printing head 11 faces the start position (transport-direction downstream-side end) of the above described blackened region Q in the border area between the two adjacent images IM, IM by a known technique, based on the print data acquired in the above described step S204, in the same manner as in step S230 in the above described FIG. 12 and FIG. 15. During the period in which the feeding has not arrived at the start position of the above described blackened region Q, the condition of step S253 is not satisfied (S253: NO), and the flow loops back and enters a standby state until the condition of step S253 is satisfied. If the feeding has arrived at the start position of the above described blackened region Q, the condition of step S253 is satisfied (S253: YES), and the flow proceeds to step S254.

In step S254, the print control portion 212A outputs a control signal to the motor driving circuits 218, 219, 220, controls the driving of the feeding motor M1, the adhesive take-up motor M2, and the separation sheet take-up motor M3 in accordance with the above described acceleration pattern, and restarts the above-described tape feeding and the take-up of the above described tape 150" with print, accelerating the speed. Additionally, the print control portion 212A outputs a control signal to the printing head control circuit 221, conducts current to the heating elements of the printing head 11, and starts print formation of the above described blackened region Q. Note that the print data for forming the blackened region Q at this time is stored in the RAM 213 in advance, for example. Subsequently, the flow proceeds to step S260.

Subsequently, in the same step S260 as that in the above described FIG. 12, the print control portion 212A determines whether or not the above described tape feeding has arrived where the printing head 11 faces the end position of the above described blackened region Q in the same step S260 as that in the above described FIG. 12, and then stops conducting current to the heating elements of the printing head 11, stopping print formation of the above described blackened region Q, in the same step S265 as that in the above described FIG. 12. The subsequent steps S300-S335 are the same as those in the above described FIG. 15, and descriptions thereof will be omitted.

In this modification as well, the same advantages as those of the above described embodiment are achieved. That is, even if the pseudo-printing section G occurs during cooling execution, when feeding is performed in the reverse direction and further in the forward direction after cooling is canceled, overwriting is performed so that the pseudo-printing section G is filled in by the above described blackened region Q (full through-up printing), making it possible to reliably improve aesthetics.

(2) When a Blackened Region is Formed Both During Through-Down and Through-Up

In this modification, one-half of the above described blackened region Q is formed up to the substantial center, and feeding is further performed to an area corresponding to three-fourths of the transport-direction length of the blackened region Q while print formation is suspended, and then turned back to the reverse direction. Then, the printing head 11 is made to face the area corresponding to one-fourth of the transport-direction length of the blackened region Q and stopped, and then the blackened region Q is once again formed along the forward direction.

That is, in this modification, the flow passes through the states respectively shown in FIG. 19A-19B, which are the same as those in FIG. 10A-10D, and print formation is stopped when the printing head 11 faces the center of the above described blackened region Q, as shown in FIG. 19C. Subsequently, feeding further advances in the forward direction and is performed until the printing head 11 faces the position corresponding to three-fourths of the transport-direction length of the blackened region Q, as shown in FIG. 19D. Subsequently, as shown in FIG. 19E, tape feeding is turned back and performed in the reverse direction, and then stopped once the printing head 11 faces the position corresponding to one-fourth of the transport-direction length of the above described blackened region Q. Subsequently, as shown in FIG. 19F, the blackened region Q is formed by the printing head 11 while tape feeding is turned back and performed once again in the forward direction. At this time, print formation is performed from the position corresponding to one-fourth of the transport-direction length of the above described blackened region Q to the end (transport-direction upstream-side end) of the blackened region Q, thereby performing print formation in duplicate from the position corresponding to one-fourth of the transport-direction length of the above described blackened region Q to the center. Note that FIG. 20 is a view conceptually showing the relative positional relationship between the printing head 11 and the tape 150" with print at this time.

With the above, at the time feeding and print formation are stopped due to cooling execution, even if the pseudo-printing section G occurs on the tape 150" with print, the pseudo-printing section G is positioned within the above described blackened region Q previously formed during through-down in the forward direction and, when feeding is performed in the reverse direction and further in the forward direction after cooling is canceled, overwriting is performed so that the above described pseudo-printing section G is further filled in at the time of formation of the blackened region Q during through-up, as shown in FIG. 19G. As a result, it is possible to reliably make the pseudo-printing section G no longer visible and suppress the effect on the outer appearance of the tape 150" with print to a minimum, thereby improving aesthetics.

Content of Control Processing

The following describes the processing content executed by the print control portion 212A of the CPU 212 for achieving the above described technique in this modification, using the flow in FIG. 21.

The flow shown in FIG. 21 differs in that step S230, step S235, step S242, step S243, step S244, step S247, and step S248 are disposed in place of step S240 in FIG. 18, and step S256 is disposed in place of steps S252-S254 in FIG. 18.

That is, the flow passes through the same steps S202-S225 as described above, and proceeds to step S230. In step S230, similar to the above described FIG. 12, after the print control portion 212A has determined whether or not tape feeding has arrived at the start position of the above described blackened region Q, in step S235, print formation of the blackened region Q is started in the same manner as described above. Note that the print data for forming the blackened region Q at this time is stored in the RAM 213 in advance, for example.

Subsequently, the flow proceeds to the newly disposed step S242. In step S242, the print control portion 212A determines whether or not the above described tape feeding has arrived where the printing head 11 faces the position corresponding to one-half (the transport-direction center) of the above described blackened region Q by a known technique, based on the print data acquired in the above described step S204. During the period in which the feeding has not arrived at the position corresponding to one-half of the above described blackened region Q, the condition of step S242 is not satisfied (S242: NO), and the flow loops back and enters a standby state until the condition of step S242 is satisfied. If the feeding has arrived at the position corresponding to one-half of the above described blackened region Q, the condition of step S242 is satisfied (S242: YES), and the flow proceeds to step S243.

In step S243, the print control portion 212A outputs a control signal to the printing head control circuit 221, and stops conducting current to the heating elements of the printing head 11 and print formation of the above described blackened region Q, in the same manner as in step S265 in the above described FIG. 18.

Subsequently, in step S244, the print control portion 212A determines whether or not the above described tape feeding has arrived where the printing head 11 faces the position corresponding to three-fourths of the transport-direction length of the above described blackened region Q by a known technique, based on the print data acquired in the above described step S204. During the period in which the feeding has not arrived at the position corresponding to three-fourths of the above described blackened region Q, the condition of step S244 is not satisfied (S244: NO), and the flow loops back and enters a standby state until the condition of step S244 is satisfied. If the feeding has arrived at the position corresponding to three-fourths of the above described blackened region Q, the condition of step S244 is satisfied (S244: YES), and the flow proceeds to step S247.

In step S247, the print control portion 212A outputs a control signal to the motor driving circuits 218, 219, 220, controls the driving of the feeding motor M1, the adhesive take-up motor M2, and the separation sheet take-up motor M3, and starts tape feeding in the reverse direction, in the same manner as in step S252 in the above described FIG. 18.

Subsequently, in step S248, the print control portion 212A determines whether or not the above described tape feeding in the reverse direction has arrived where the printing head 11 faces the position corresponding to one-fourth of the transport-direction length of the above described blackened region Q by a known technique, based on the print data acquired in the above described step S204. During the period in which the feeding has not arrived at the position corresponding to one-fourth of the above described blackened region Q, the condition of step S248 is not satisfied (S248: NO), and the flow loops back and enters a standby state until the condition of step S248 is satisfied. If the feeding has arrived at the position corresponding to one-fourth of the above described blackened region Q, the condition of step S248 is satisfied (S248: YES), and the flow proceeds to step S249.

In step S249, the tape feeding in the reverse direction is stopped in the same manner as in the above described FIG. 18. Subsequently, after the print control portion 212A has determined whether or not a production restart instruction signal from the cooling control portion 212B has been input in the same step S250 as described above, the flow proceeds to the newly disposed step S256.

In step S256, the print control portion 212A outputs a control signal to the motor driving circuits 218, 219, 220, controls the driving of the feeding motor M1, the adhesive take-up motor M2, and the separation sheet take-up motor M3 in accordance with the above described acceleration pattern, and restarts the above-described tape feeding and the take-up of the above described tape 150" with print, accelerating the speed. Additionally, the print control portion 212A outputs a control signal to the printing head control circuit 221, conducts current to the heating elements of the printing head 11, and starts print formation of the above described blackened region Q. Subsequently, the flow proceeds to step S260. The steps S260-S335 thereafter are the same as those in the above described FIG. 18, and descriptions thereof will be omitted.

In this modification as well, the same advantages as those of the above described embodiment are achieved. That is, even if the pseudo-printing section G occurs at the time of cooling execution, the pseudo-printing section G is positioned within the above described blackened region Q previously formed during through-down, and overwriting is further performed so that the pseudo-printing section is filled in at the time of formation of the blackened region Q during the through-up after cooling is canceled. As a result, it is possible to reliably improve aesthetics.

(3) When Take-up Tension is Released Immediately Before Reverse Feeding

In this modification, if the blackened region is formed both during through-down and through-up as in the modification of the above described (2), take-up tension from the winding core 41 is released in order to more easily execute the aforementioned reverse-direction feeding. Note that components identical to those in the modification of the above described (2) are denoted using the same reference numerals, and descriptions thereof will be omitted or simplified as appropriate.

That is, in this modification, the flow passes through the state shown in FIG. 22A, which is the same as that in FIG. 19A, and, when the printing head faces the position corresponding to one-fourth of the transport-direction length of the blackened region Q shown in FIG. 22B, take-up of the tape 150" with print by the above described take-up mechanism 40 stops. As a result, as shown in FIG. 22C corresponding to FIG. 19C, subsequent tape feeding advances while the take-up side of the take-up mechanism 40 is slackened, and printing is stopped when the printing head 11 faces the center of the blackened region Q. Then, as shown in FIG. 22D corresponding to FIG. 19D, feeding is performed until the printing head 11 faces the position corresponding to three-fourths of the transport-direction length of the blackened region Q (while the above described take-up side is continuously slackened). Subsequently, as shown in FIG. 22E corresponding to FIG. 19E, tape feeding is turned back and performed in the reverse direction to the position corresponding to one-fourth of the transport-direction length of the above described blackened region Q while the above described slackened section is extended, and then stopped (thereby resolving the entire aforementioned slackened section). Subsequently, as respectively shown in FIGS. 22F-22G corresponding to FIGS. 19F-19G, the remaining three-fourths of the blackened region Q are formed into print at once by the printing head 11 while the tape feeding is turned backed and performed once again in the forward direction, in the same manner as described above.

Content of Control Processing

The following describes the processing content executed by the print control portion 212A of the CPU 212 for achieving the technique in this modification, using the flow in FIG. 23.

The flow shown in FIG. 23 differs in that step S239 and step S241 are newly disposed between step S235 and step S242 in the above described FIG. 21.

That is, the flow passes through the same steps S202-S235 as described above, and proceeds to step S239. In step S239, the print control portion 212A, similar to step S248 in FIG. 21, determines whether or not the above described tape feeding in the reverse direction has arrived where the printing head 11 faces the position corresponding to one-fourth of the transport-direction length of the above described blackened region Q by a known technique, based on the print data acquired in the above described step S204. During the period in which the feeding has not arrived at the position corresponding to one-fourth of the above described blackened region Q, the condition of step S239 is not satisfied (S239: NO), and the flow loops back and enters a standby state until the condition of step S239 is satisfied. If the feeding has arrived at the position corresponding to one-fourth of the above described blackened region Q, the condition of step S239 is satisfied (S239: YES), and the flow proceeds to step S241.

In step S241, the print control portion 212A outputs a control signal to the motor driving circuits 219, 220, controls the driving of the adhesive take-up motor M2 and the separation sheet take-up motor M3, and stops the take-up of the tape 150" with print on the outer circumference side of the winding core 41 and the take-up of the separation material layer 151 on the separation material roll R3. Subsequently, the flow proceeds to the above described step S242. Steps S242 and thereafter are the same as those in FIG. 21, and descriptions thereof will be omitted.

In this modification, in the technique in the modification of the above described (2), when feeding in the reverse direction is performed, the region corresponding to one-fourth to one-half of the transport-direction length of the blackened region Q (that is, equivalent to one-fourth of the total length of the blackened region Q), equivalent to the reverse-direction length, is slackened. With this arrangement, when feeding is subsequently performed in the above described reverse direction, it is possible to smoothly perform reverse-direction feeding in a reasonable manner while sequentially extending the above described slackened section.

(4) Other

Note that while the above has described an illustrative scenario in which the print control portion 212A controls the stopping and restarting of tape feeding and print formation in accordance with a pause instruction signal output from the cooling control portion 212B during cooling execution, the present disclosure is not limited thereto. That is, for example, the above described technique may be applied in a case where a pause instruction signal output from the operation part 216 (or the above described PC 217) is input to the print control portion 212A based on an emergency stop operation of the operation part 216 (or the above described PC 217) by the user, and the stopping and restarting of the above described tape feeding and print formation are controlled in accordance thereto. In this case as well, the same advantages are achieved.

Note that, in the above, the arrows shown in FIG. 7 denote an example of signal flow, but the signal flow direction is not limited thereto.

Also note that the present disclosure is not limited to the procedures shown in the above described flows of the flowcharts in FIG. 8, FIG. 12, FIG. 15, FIG. 18, FIG. 21, FIG. 23, and the like, and procedure additions and deletions as well as sequence changes and the like may be made without deviating from the spirit and scope of the disclosure.

Further, other than that already stated above, techniques based on the above described embodiments and each of the modifications may be suitably utilized in combination as well.

What is claimed is:

1. A printer comprising:

a feeder configured to feed a recording medium along a predetermined feeding path;

a thermal head comprising heating elements that face said predetermined feeding path;

a conducting device configured to conduct current to said heating elements; and a first control portion configured to control said feeder and said conducting device to perform printing on said recording medium;

said first control portion executing:

a first processing including printing on said recording medium while feeding said recording medium in a forward direction along said predetermined feeding path, based on first print data;

detecting a print stop instruction, the print stop instruction received from an external source during the printing of the first processing, the external source being external to the printer, the print stop instruction instructing the printer to stop all current printing being performed by the printer;

in response to detecting the print stop instruction from the external source during the first processing:

a second processing including initiating printing on a first predetermined section of said recording medium while continuously feeding said recording medium in the forward direction along said predetermined feeding path, based on second print data that differs from said first print data, the second processing not being performed by the printer at the time the print stop instruction is detected; and after the second processing, a third processing for feeding said recording medium in a reverse direction opposite to said forward direction along said feeding path and, with current conduction to said heating elements stopped, making said heating elements face said first predetermined section of said recording medium for a first predetermined amount of time, wherein, when the heating elements face the first predetermined section, the thermal head is configured to print in the first predetermined section without moving the recording medium.

2. The printer according to claim 1, wherein:

said first control portion controls said feeder and said conducting device so as to perform said second processing after completion of printing on said recording medium based on said first print data, when said print stop instruction is received in the middle of said first processing.

3. The printer according to claim 1, wherein:

said first control portion controls said feeder and said conducting device so as to gradually decrease a speed at which said recording medium is fed during execution of said second processing.

4. The printer according to claim 1, wherein:

said first control portion further executes, after the third processing and while feeding said recording medium in said forward direction along said feeding path, a fourth processing for performing printing on a section of said recording medium, wherein the section is a portion of the recording medium which said heating elements face when a transport direction of said recording medium is switched from said forward direction to said reverse direction.

5. The printer according to claim 4, wherein:

said first control portion controls said feeder and said conducting device so as to gradually increase a speed at which said recording medium is fed during execution of said fourth processing.

6. The printer according to claim 5, wherein:

said first control portion controls said feeder and said conducting device so as to perform printing from the start of said fourth processing.

7. The printer according to claim 1, wherein:

said first predetermined section of said recording medium is a section across substantially an entire width of said recording medium; and said first control portion controls said feeder and said conducting device so as to perform printing on the entire section of said first predetermined section during execution of said first processing.

8. The printer according to claim 7, wherein:

said first control portion controls said feeder and said conducting device so as to make said heating elements face a substantial center section of said first predetermined section of said recording medium in a transport direction in which the recording medium is conveyed, during execution of said third processing.

9. The printer according to claim 1, further comprising a take-up portion that is configured to take up said recording medium fed by said feeder, and is disposed on said predetermined feeding path on a downstream side than said thermal head, wherein said first control portion controls said take-up portion so as to take up said recording medium until a first predetermined section of said recording medium faces said heating elements during execution of said second processing, and subsequently stop take-up of said recording medium until completion of execution of said third processing.

10. The printer according to claim 1, further comprising an ink ribbon fed while sandwiched by said heating elements and said recording medium.

11. The printer according to claim 10, wherein:

said first control portion controls said feeder and said conducting device so as to conduct current to heating elements corresponding to an entire width-direction region of said ink ribbon and perform printing on said first predetermined section during execution of said second processing.

12. The printer according to claim 11, wherein:

said first control portion controls said feeder and said conducting device so as to perform full dot printing on said first predetermined section.

13. The printer according to claim 1, further comprising:

a temperature detecting device configured to detect a temperature of said thermal head; and a transmitting portion configured to transmit said print stop instruction to said first control portion when a detected temperature by said temperature detecting device reaches a predetermined print stop temperature.

* * * * *